United States Patent [19]

Vial

[11] 3,968,560

[45] July 13, 1976

[54] PALLET ASSEMBLING SYSTEM

[75] Inventor: Garye R. Vial, Riverside, Calif.

[73] Assignee: FMC Corporation, San Jose, Calif.

[22] Filed: Dec. 16, 1974

[21] Appl. No.: 533,436

[52] U.S. Cl. ..... 29/430; 29/200 A; 29/208 F; 227/100; 227/152; 227/45; 227/49

[51] Int. Cl.[2] ..... B27M 1/08; B27B 31/00; B27C 9/00

[58] Field of Search ..... 29/430, 200 A, 208 R, 29/208 F, 211 R; 144/3 R; 227/27, 99, 100, 101, 103, 152, 44, 45, 48–50

[56] References Cited

UNITED STATES PATENTS

| | | | |
|---|---|---|---|
| 2,075,795 | 4/1937 | Babcock | 29/211 R |
| 2,111,081 | 3/1938 | Taylor | 227/45 |
| 2,456,221 | 12/1948 | Stilwell et al. | 227/45 |
| 3,090,961 | 5/1963 | McRae et al. | 227/45 |
| 3,552,624 | 1/1971 | Dykeman | 227/100 |
| 3,557,439 | 1/1971 | Dykeman | 29/430 |
| 3,688,965 | 9/1972 | Kellner et al. | 29/430 |
| 3,755,871 | 9/1973 | Nelson | 29/430 |

*Primary Examiner*—C. W. Lanham
*Assistant Examiner*—Dan C. Crane
*Attorney, Agent, or Firm*—R. S. Kelly; C. E. Tripp

[57] ABSTRACT

An automatic pallet assembling system which includes a pair of conventional nailing machines for separately nailing each side of a pallet and conveying means for carrying the half-finished pallet between the nailing machines. The stringers and deck boards are automatically fed to the first nailing machine in the proper sequence for nailing. After nailing, the half-finished pallet is automatically turned over and offset with respect to its direction of movement before being fed to the second nailing machine where the final set of deck boards are automatically fed into position for nailing. With five personnel (including two inspectors) operating the assembly system, a production rate of up to eight pallets per minute can be achieved.

18 Claims, 30 Drawing Figures

FIG_3
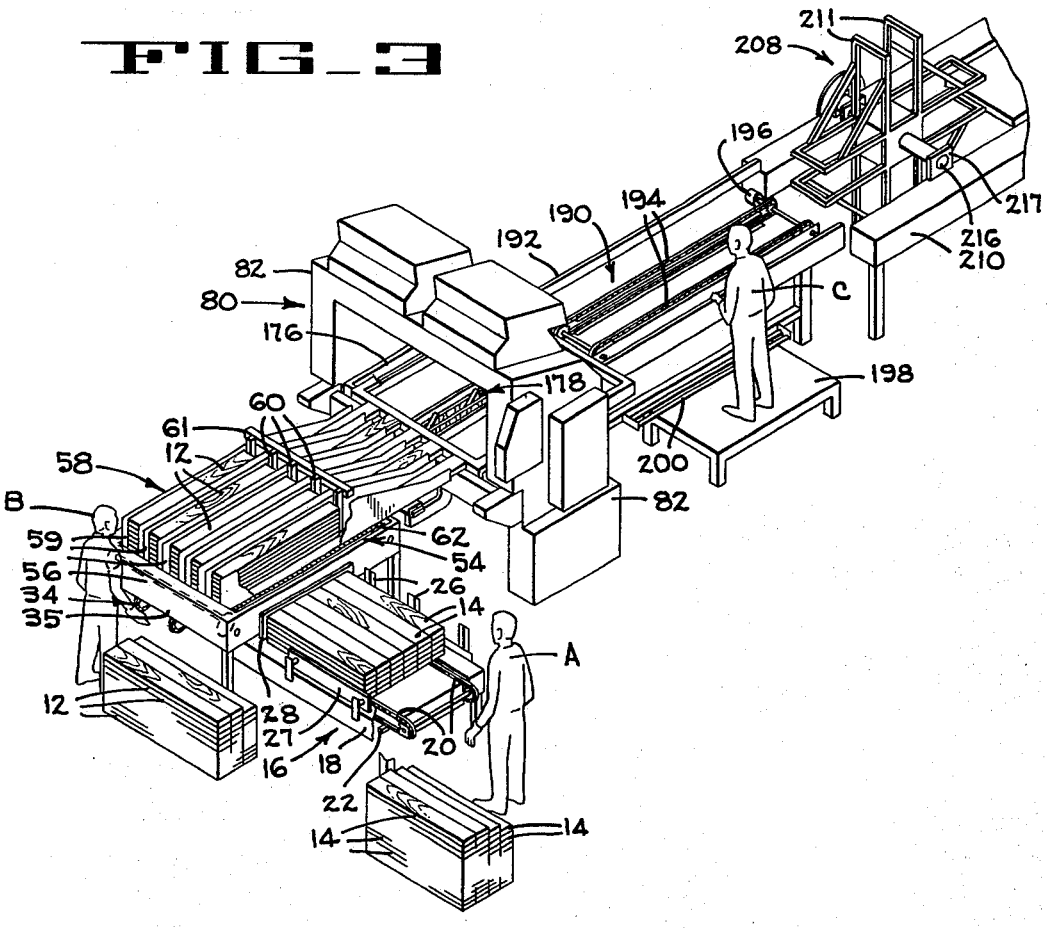
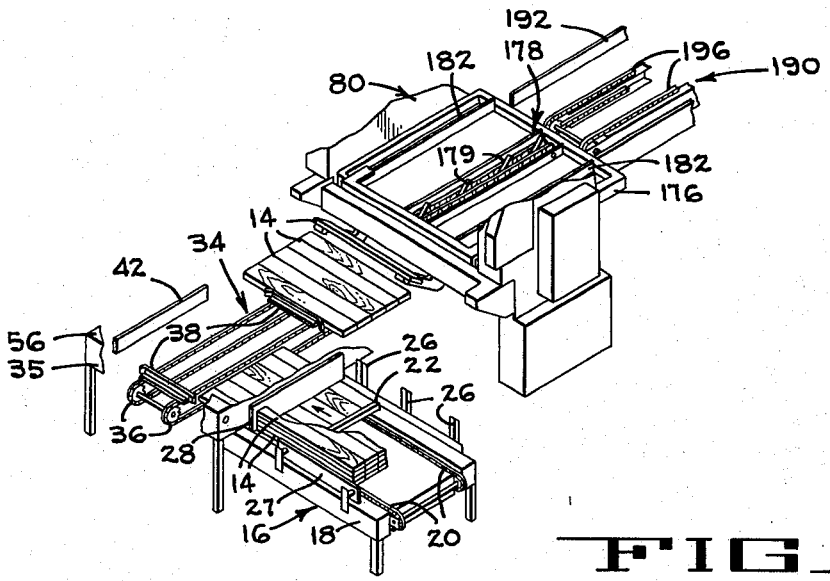
FIG_4

130
132
127
129b
129
129a
131
128
126
140
LS3B
142
141
12
14
121
122
137
138
120
124
125
116
150
108
136
133
134
LS3A

FIG_9
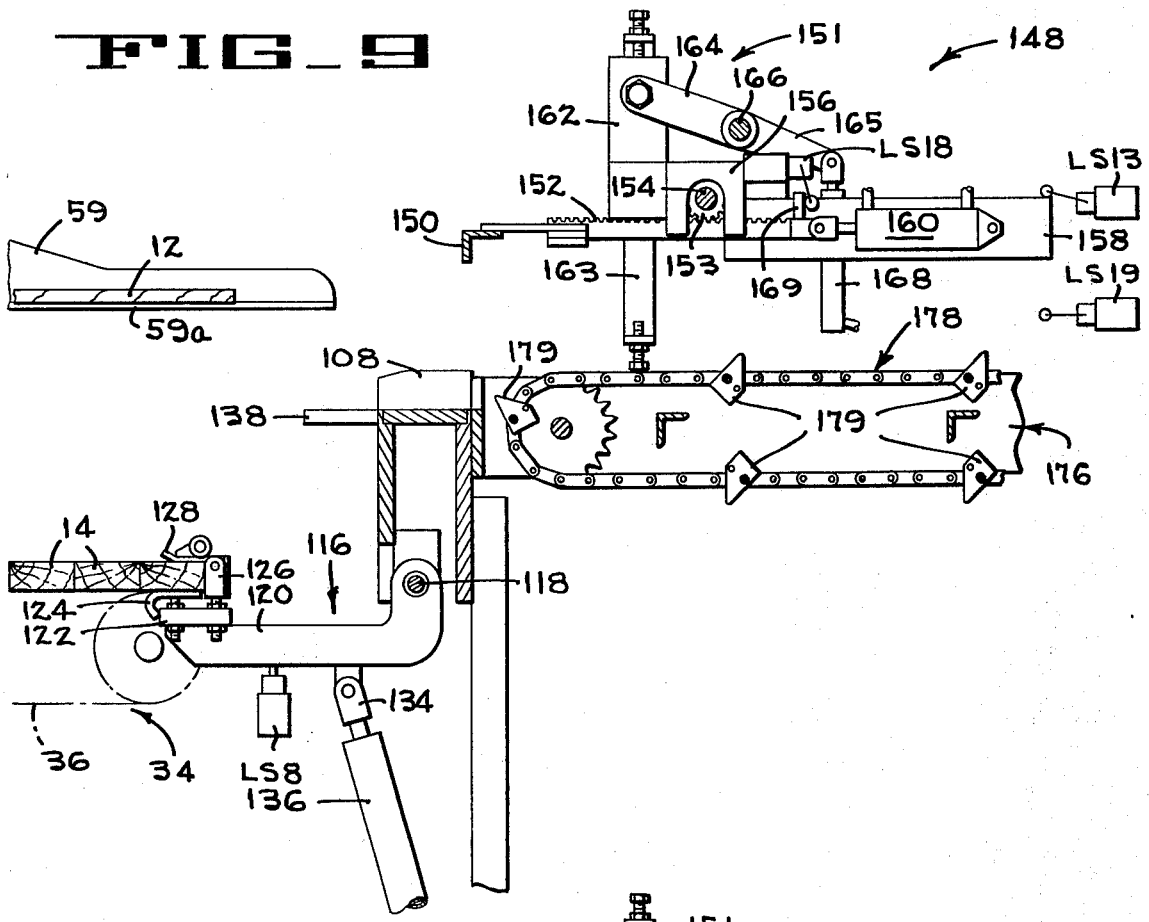
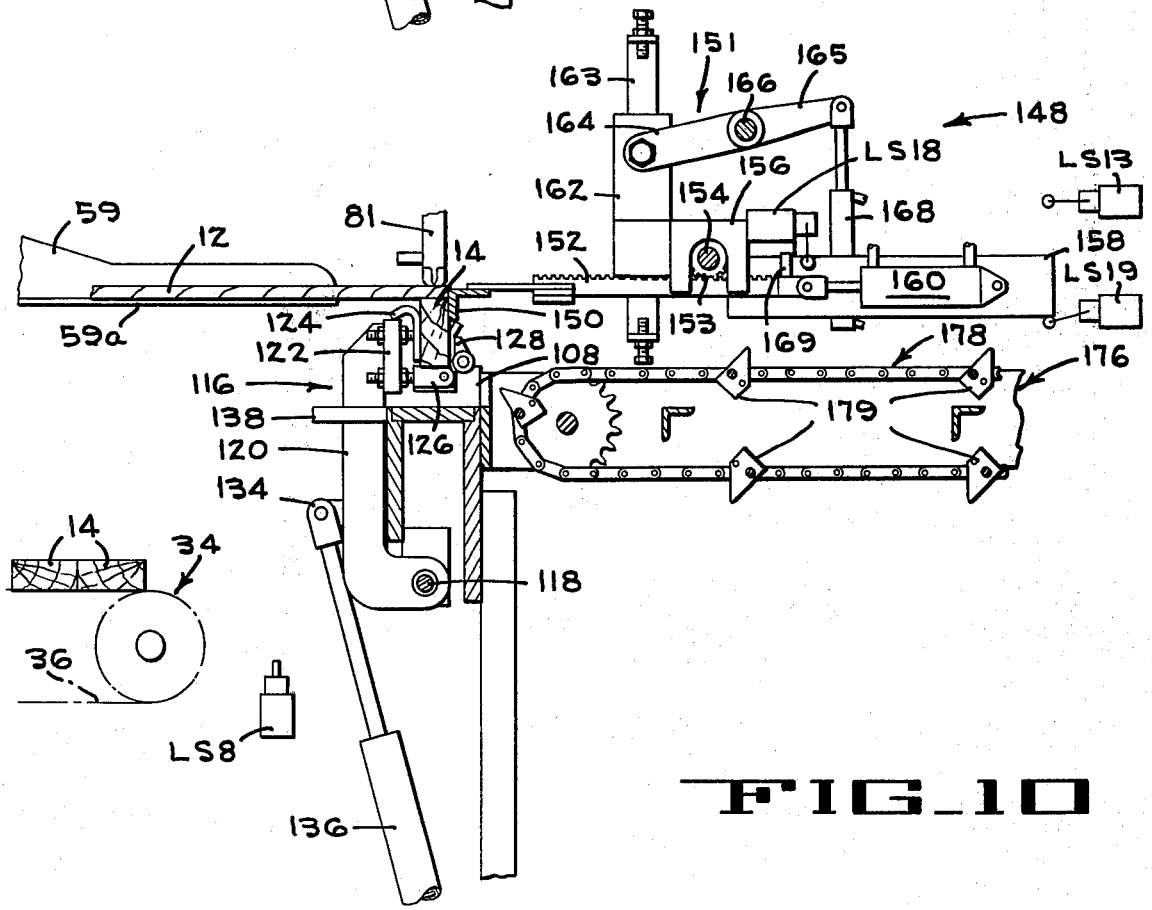
FIG_10

FIG_11
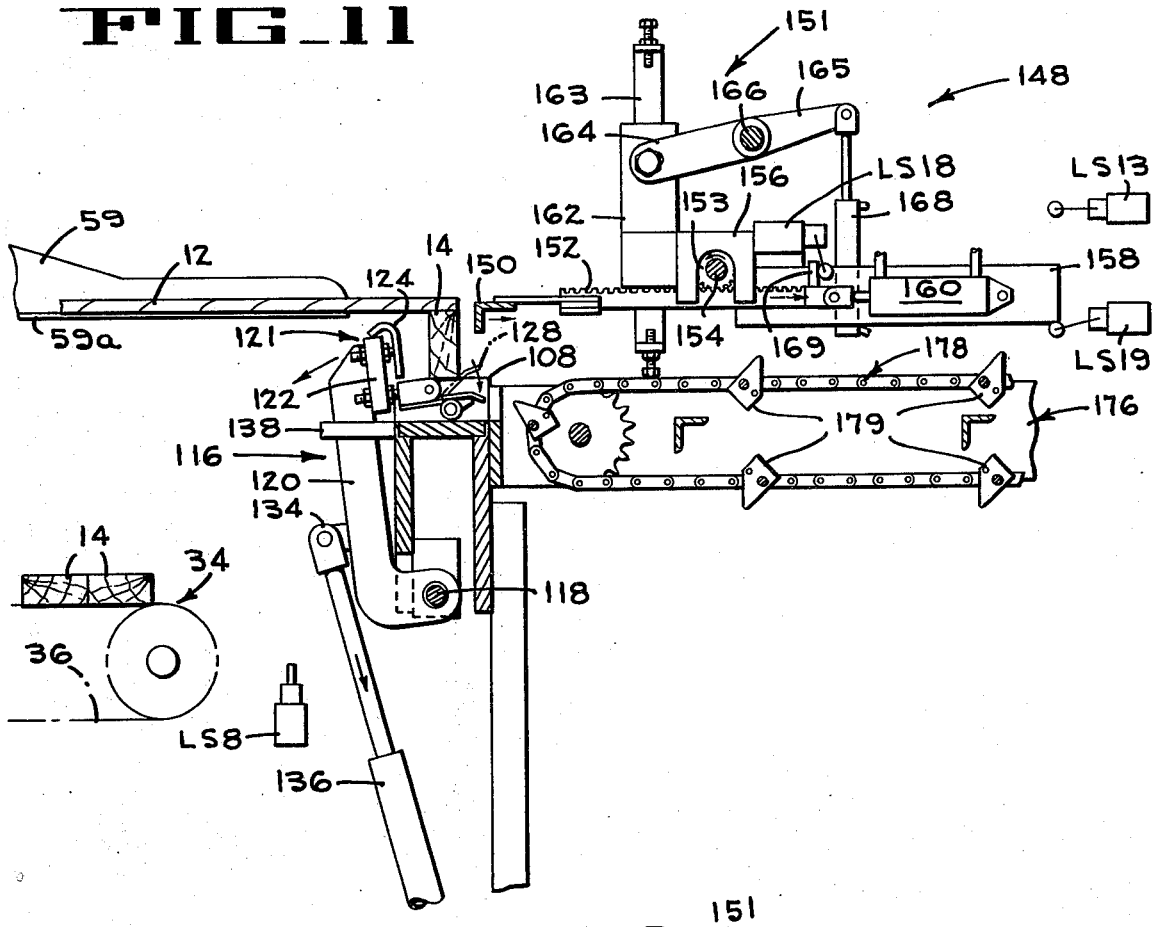
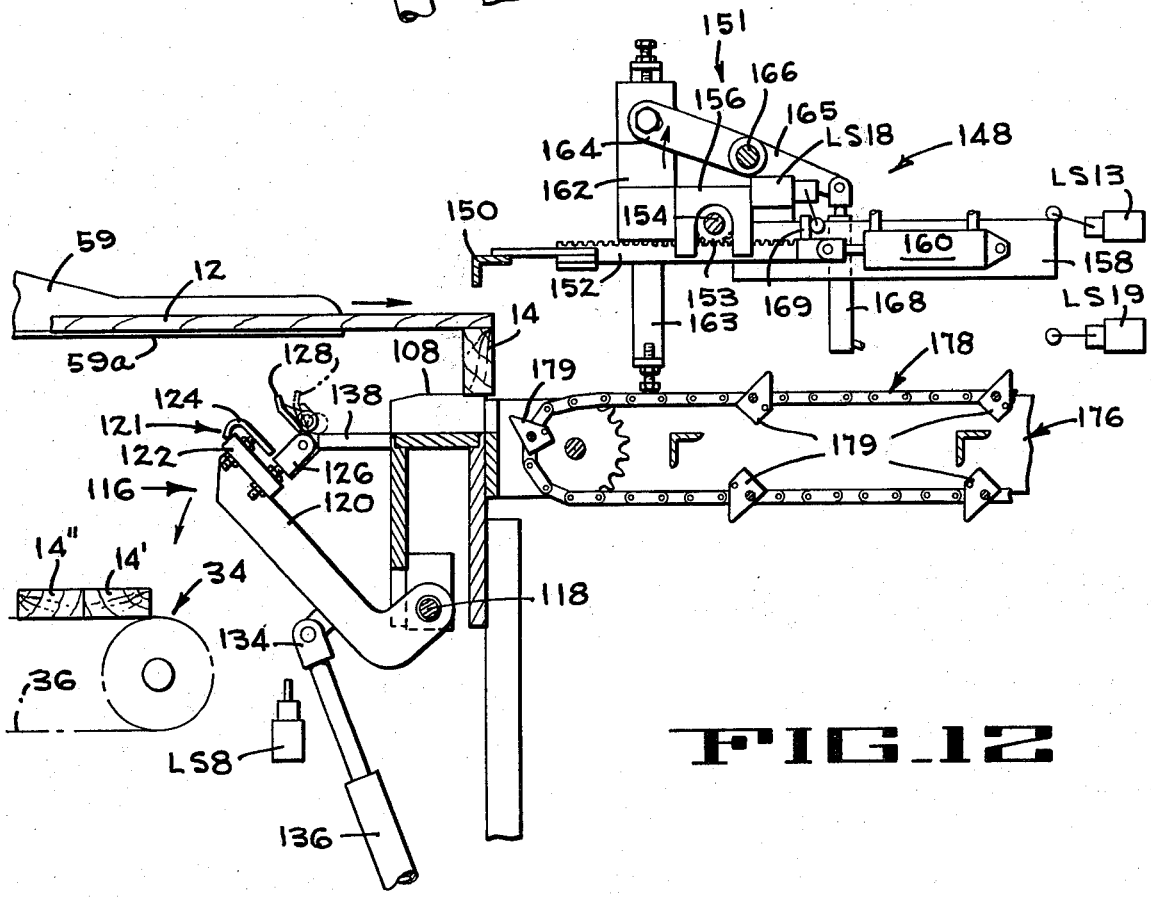
FIG_12

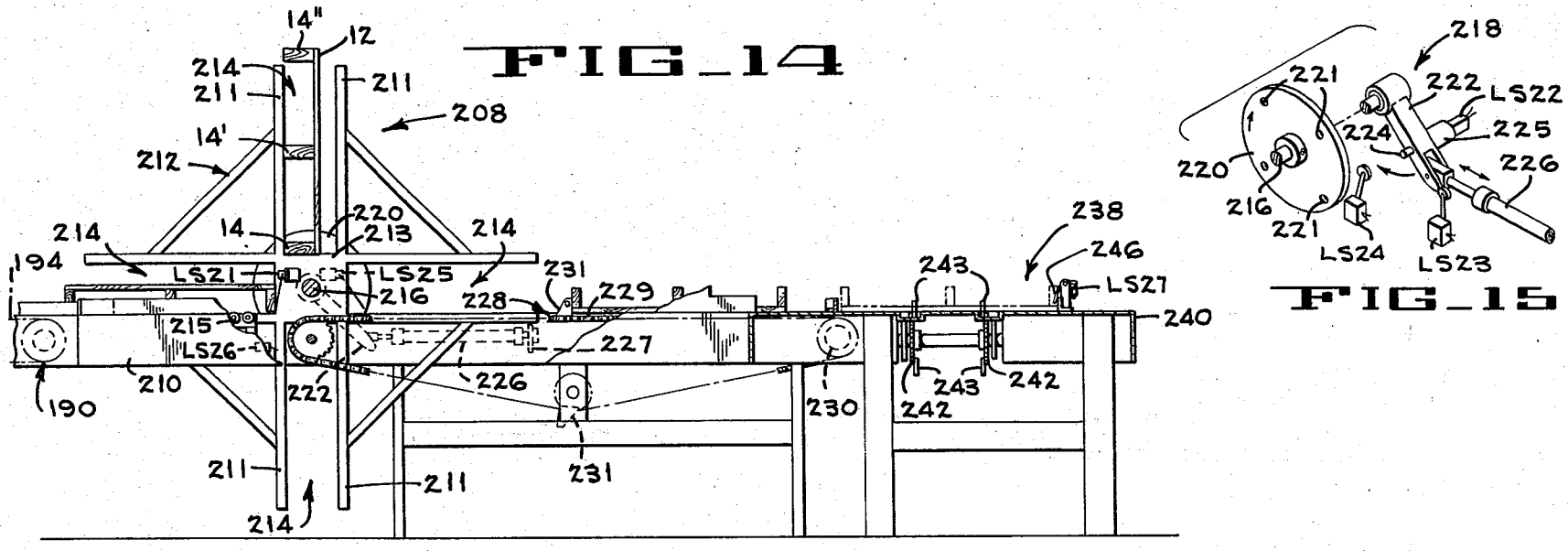
FIG_14
FIG_15
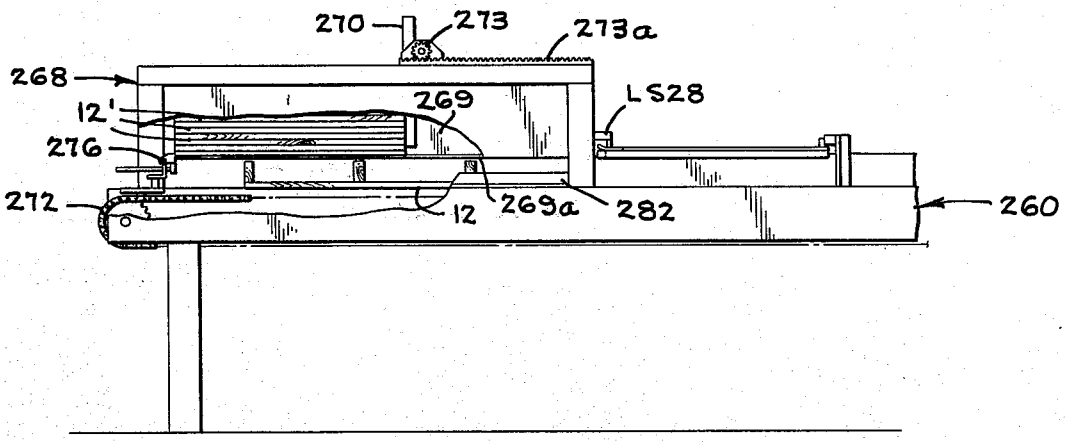
FIG_16A

M1
C100
STOP
START
SW-1
CR 100
C100
LS2
CR 101
C1
C101
CR 102
LS1
C102
NAILER CLUTCH
SOL-20
C102
LS3A
LS3B
C12
LS4
CR 1
C10
C1
CR 2
LS2
CR 2A
LS6
LS7
CR 3
C3
C3
SOL-1
STRINGER LOADER "ON"
LS8
C3
C4
SOL-2
LS9
STRINGER FEEDER "ON"
LS10A
LS10B
C2
CR 4
C4
C4
LS3A
LS3B
LS-50
CR 5
C2
C5
SOL-3
STRINGER LIFTING ASSEMBLY "UP"
C12
LS11
CR 6
C6

M2
C100
STOP
START
SW-1
C100
CR 100
C101
LS2
CR 101
LS32
C101
CR 102
LS1
C102
NAILER CLUTCH
SOL-20
C102
LS2
CR 2
CR 2A
LS21
LS25
C51
LS22
CR 31
C31
C31
SOL-10
INDEXING ARM "OUT"
LS23
LS24
CR 41
C41
C41
SOL-11
PIN "IN ENGAGEMENT"
LS27
LS26
CR 51
LS25
C51
SOL-12
TURNOVER CONVEYOR "ON"
LS29
CR 61
LS27
LS28
C61
SOL-13
DIVERTER CONVEYOR "ON"

PALLET ASSEMBLING SYSTEM

BACKGROUND OF THE INVENTION

1. Field of the Invention

The present invention pertains to methods and means for automatically assembling and nailing together wood frame components, and more particularly, it pertains to methods and means for assembling and nailing together the component parts of conventional wooden pallets which are comprised of a plurality of parallel spaced stringers interconnected by one or more sets of parallel spaced deck boards.

2. Description of the Prior Art

Wooden pallets, which are used to support stacked loads of goods, have become increasingly important to many phases of industry due to a general trend toward automated material handling systems to reduce the time consuming costly manual labor involved in hand stacking and transporting operations. Although pallets may come in a variety of specific designs, the most commonly used type basically comprises a series of spaced wooden stringers which are secured together in parallel relationship by a plurality of aligned deck boards running crosswise to both their top and bottom side edges. Due to the heavy demand for such structures, pallet manufacturers have long been seeking methods and means to efficiently increase their production rates without the addition of offsetting increased labor costs. These heavy labor costs are primarily due to the time and the number of men needed in the assembly of and the nailing together of the various component parts of the pallets.

Various automated pallet assembling systems have been proposed in the past, one such system being shown in U.S. Pat. No. 3,557,439 to Dykeman, which issued on Jan. 26, 1971. The pallet assembling system disclosed in that patent generally comprises a continuous flow system wherein two automatic nailing machines are utilized for separately nailing the deck boards on each side of the stringers. A turnover device is arranged between the nailing machines to automatically flip the half-finished pallet over so that the second set of deck boards can be readily placed atop the unnailed faces of the stringers. The assembling system as disclosed in aforementioned Dykeman patent, however, does not include means for automatically assembling the stringers and the deck boards. Since these component parts of the pallet have to be placed by hand into an assembly jig before the jig can be moved to the nailing machine, the time required for the pallet making operation is not as fast as it might otherwise be with a fully automatic operation.

In recent years, other complete pallet nailing systems have been provided which utilize two nailing machines and wherein the deck boards and the stringers are separately fed into the nailing machines and automatically assembled therein prior to nailing. In one such system, the two nailing machines are aligned in a straight line path and are each provided with special deck board feeders which operate to automatically slide an entire set of deck boards over to the nailing anvils of the nailing machines in position to be nailed to the underlying stringers. The stringers are separately and individually located in pockets on a stringer conveyor which carries them beneath the aligned deck boards and, through appropriate control means, stops in the proper positions for nailing. Such pallet nailing system has not achieved wide popularity in the pallet making industry, however, since at least five men are required to load the deck boards and stringers for an efficient operation. Also, operational problems of various types have been encountered with such system.

SUMMARY OF THE INVENTION

With the apparatus of the present invention a pallet making means and method is provided whereby but five men (including two inspectors) can be utilized along with two conventional automatic nailing machines to completely assemble pallets at production rates of up to eight pallets per minute. Generally, the pallet assembling system of the present invention includes a means for automatically feeding the deck boards to each of the nailing machines and further includes automatic means for individually bringing up the stringers into position beneath the overlying deck boards so that the deck boards can be nailed thereto. Thus, both the stringers and the deck boards can be rapidly loaded in stacks in magazines so that a minimum number of loaders will be required.

In the preferred form of the invention the pallet assembling line includes an offset in the work flow path so that the deck board feeding magazine for the second nailing machine can be directly loaded from the upstream end thereof by inserting stacks of boards in the longitudinal direction so that but a single operator is all that is required for this operation. Also, in the preferred form of the invention, a specially provided back gauge is utilized to stop the deck boards at the proper position adjacent to the nailing anvil to assure that the finished pallet will have a uniform and even appearance.

BRIEF DESCRIPTION OF THE DRAWINGS

FIG. 3 is a diagrammatic perspective view of the upstream end of the pallet nailing system of the present invention and particularly illustrates the first nailing machine and its feed means, the inspection conveyor, and the turnover assembly.

FIG. 4 is a diagrammatic perspective view of the upstream portion of the pallet nailing system similar to FIG. 3 but illustrating particularly the means whereby the stringers are fed into the first nailing machine.

FIGS. 9–12 are operational views illustrating the operation of the stringer lifting assembly and the back gauge at the nailing anvil of the first nailing machine.

FIG. 14 is a section taken on line 14—14 of FIG. 13.

FIG. 15 is an enlarged isometric detail view of the indexing wheel assembly of the turnover assembly shown in FIG. 14.

FIGS. 16A and 16B together comprise a diagrammatic side elevation of the front table and the second nailing machine of the pallet assembling system of the present invention.

DESCRIPTION OF THE PREFERRED EMBODIMENT

General Description

Figures 1A, 1B, 2:
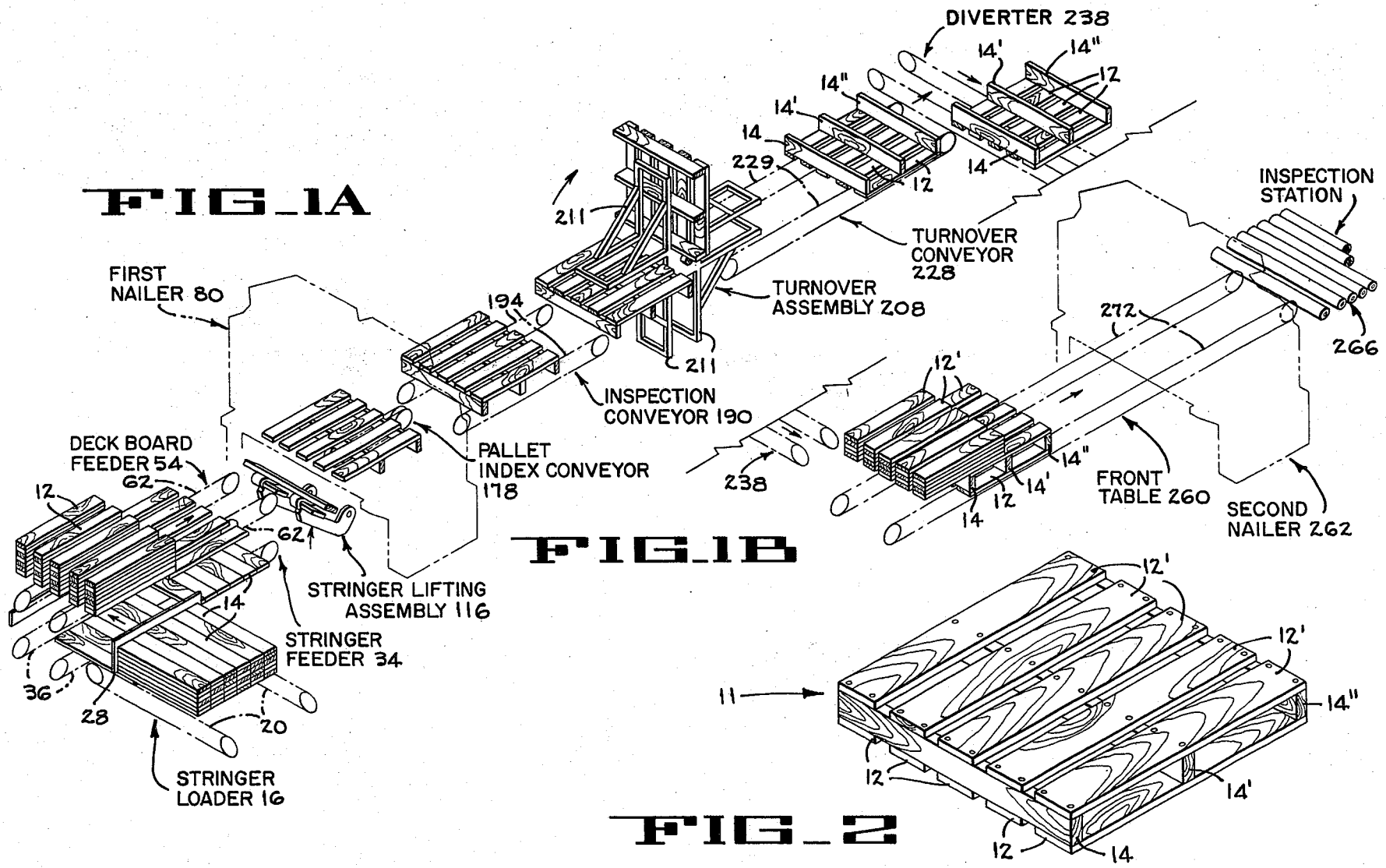
FIGS. 1A and 1B together comprise a diagrammatic layout of the overall pallet assembling system of the present invention.
FIG. 2 is an isometric detail view of one of the pallets which is assembled and nailed by the apparatus of the present invention.

Referring first to FIG. 2, reference numeral 11 generally indicates a wooden pallet of the type which may be constructed with the apparatus of the present invention. This pallet comprises two layers of parallel deck boards 12 separated by three stringers 14 which extend transversely to the deck boards and are nailed thereto along the ends and the centers thereof. Reference numerals 12, 12′ and 14, 14′ and 14″ have been used in FIG. 2 in order to indicate the respective nailing sequences of the deck boards and stringers, i.e., the order in which the various deck boards and stringers are arranged to be nailed by the apparatus of the present invention.

Referring now to the general schematic diagram of FIGS. 1A and 1B, it will be seen that the assembly operation starts with the loading of loose stringers and deck boards into the apparatus of the present invention prior to the advancement of the same into position to be nailed. The stringers 14 are manually loaded into a stringer loader 16 that is positioned transversely to the main work flow. The stringer loader 16 sweeps the entire bottom layer (six boards) out of the stringer stack and side loads the layer onto a stringer feeder 34. The stringer feeder comprises a conveyor which advances each of the stringers carried thereby step by step toward a first nailer, i.e., nailing machine, 80. The stringer loader 16 sweeps another layer of stringers out of the stack whenever the stringer feeder advances the stringers thereon sufficiently to permit the side loading of an additional layer.

The deck boards 12 are stacked in parallel rows that are longitudinally aligned with the direction of the work flow. The deck boards are brought up to the first nailer 80 by a deck board feeder 54. At the first nailer a stringer lifting assembly 116 grabs the foremost stringer 14 from the stringer feeder 34 and rotates the stringer upwardly 90° to a position directly beneath the advancing deck boards 12. When the first stringer is in place below the projecting ends of the deck boards, the first nailer simultaneously nails all of the deck boards to the stringer.

After the first nailing operation the deck boards 12 and the first stringer 14 are transported forward by the deck board feeder until they are received by a pallet index conveyor 178 while the stringer lifting assembly 116 brings up the second stringer 14′ into position to be nailed. When the second stringer 14′ is in place below the center of the deck boards 12, the first nailer drives a second set of nails. After the second nailing operation the pallet is again moved forwardly by the pallet index conveyor while the stringer lifting assembly brings up the third stringer 14″ into position to be nailed. When the third stringer 14″ is in place below the trailing ends of the deck boards, the first nailer drives the third set of nails and thus completes the nailing of one side of the pallet.

After the third set of nails is driven, the pallet is moved out of the first nailer 80 and onto an inspection conveyor 190. The pallet travels on the inspection conveyor while an operator checks the quality of the wood and the placement of the nails. After passing across the inspection conveyor, the pallet is flipped over 180°—by a turnover assembly 208—and transported therefrom by a turnover conveyor 228 and a diverter 238. The combination of the turnover conveyor and the diverter provide a 90° offset in the work flow of the pallet making machine.

A second set of deck boards 12′ is manually stacked in a magazine on a front table 260 in longitudinal alignment with and above the work flow. When the half-formed pallet is advanced into a second nailer 262 upon the front table, a conveyor on the front table also advances the second set of deck boards 12′ in overlying relationship with the pallet. The second nailer applies three sets of nails to secure the pallet and the deck boards 12′ in an operation similar to the operation performed by the first nailer. Thereafter, the completed pallet is inspected at an inspection station and stacked for subsequent processing.

The Stringer Loader

Referring to FIGS. 3, 4, 5 and 6, reference numeral 16 generally indicates a stringer loader which comprises a stringer loader table 18 on which the stringers 14 are stacked prior to entry into the pallet assembling apparatus. The stringers are manually stacked transversely to the work flow by an operator A, as indicated in FIG. 3. Mounted on the stringer loader table 18 in parallel relationship are a pair of endless chains 20 to which are attached two pusher bars 22. The chains 20 form a continuous conveyor extending into the pallet assembling apparatus, and the pusher bars are arranged transversely to the chains and supported at locations spaced 180° apart on said chains. The stringer loading chains are operated by a motor 24 (FIGS. 5 and 6) which is a conventional hydraulic motor and is actuated by two limit switches LS6 and LS9 on the stringer feeder 34 as hereinafter described. The stringers 14 are kept in transverse alignment on the stringer loader table by a plurality of upright guides 26 and by a side plate 27 (FIGS. 3 and 4).

Figures 5, 6:
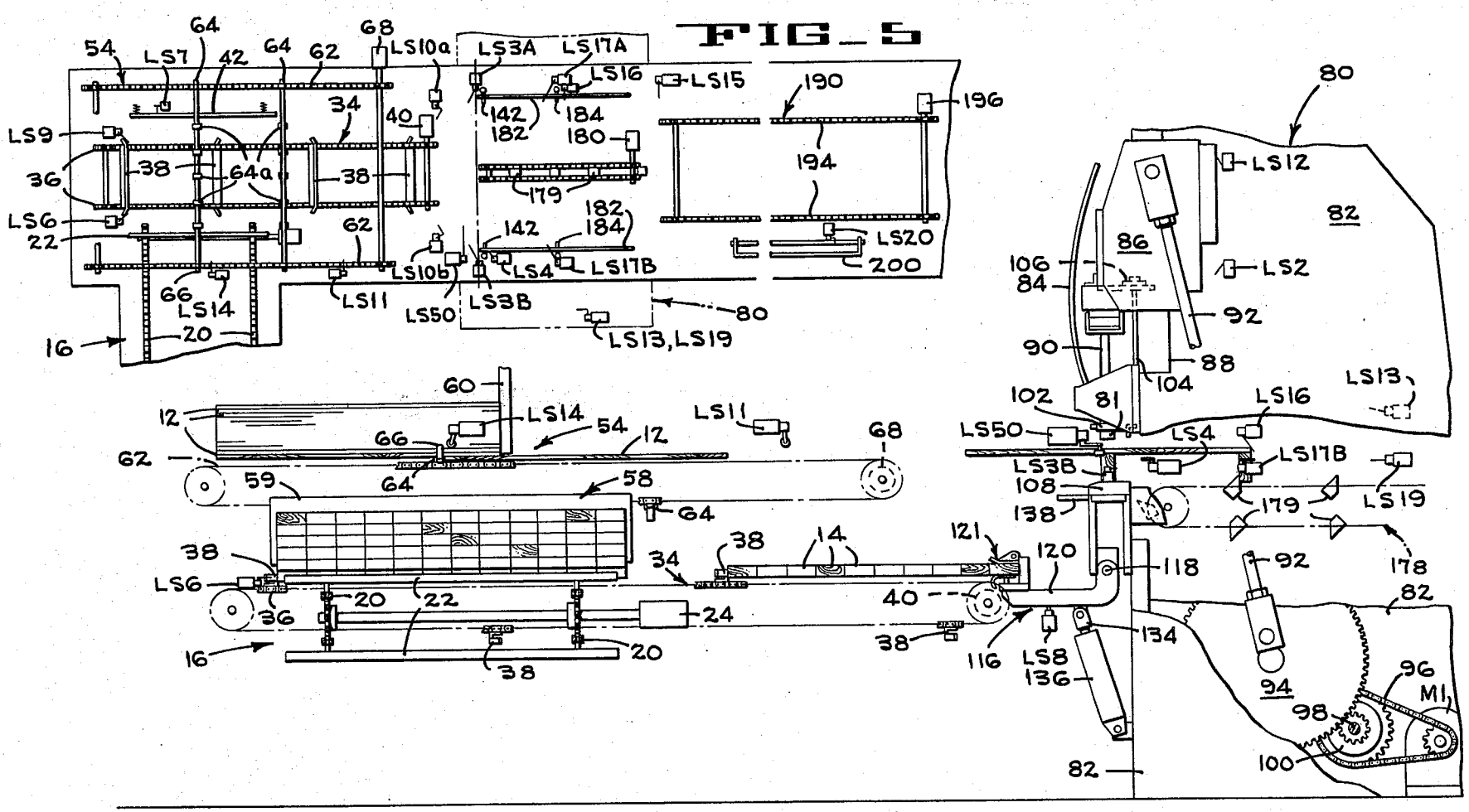
FIG. 5 is a diagrammatic plan view of the first nailing machine and its various feed and discharge means and particularly illustrates the relationship of the various conveyors and the control switches.
FIG. 6 is a diagrammatic side elevation of the first nailing machine and the feed means therefor with various portions thereof being broken away and removed for the purpose of clarity.

In operation, the stringer loader 16 cycles on command to advance the bottom most layer of stringers onto the stringer feeder 34 and into the work flow of the pallet assembling apparatus. Each pusher bar 22 engages only the lowest layer of stringers and advances it out from underneath the stack of stringers while the stack is held in place by a vertical stop plate 28. After the layer of stringers has passed from beneath the stack, the stack falls by gravity into position for the next cycle. By means to be explained in greater detail hereinafter, the endless conveyor chains 20 are driven through 180° to bring one pusher bar 22 from a position adjacent to the infeed end of the stringer loader, as shown in FIG. 3, to a position which centers the stringers over the stringer feeder 34, as shown in FIG. 5.

The Stringer Feeder

Referring to FIGS. 1 and 4–6, reference numeral 34 generally indicates a stringer feeder. The stringer feeder transports the layer of stringers from the stringer loader 16 to the first nailer 80. The stringer feeder includes a table 35 on which the transversely aligned stringers are fed one by one into the first nailer. Arranged on the stringer feeder table are a pair of parallel stringer feeder chains 36 having attached thereto a plurality of spaced pusher bars 38. The pusher bars engage the trailing edge of a group of the stringers and advance the stringers along the stringer feeder table 35. The stringer feeder pusher bars 38 individually actuate two limit switches, LS6 and LS9, located at the rear of the stringer feeder table as the pusher bars move into position to receive the stringers, the purpose of such switches being hereinafter described. The stringer feeder chains 36 are advanced by a stringer feeder conveyor motor 40 (FIG. 5) which is a conventional hydraulic motor that is started by a limit switch LS8 and stopped by two limit switches **LS10*a* and LS10*b*. The limit switch LS8 is actuated by the stringer lifting assembly 116 hereinafter described in greater detail, and the limit switches LS10*a* and LS10*b* are actuated when a stringer is in place in the stringer lifting assembly 116. Located on the stringer feeder table 35 in the path of the transversely advancing stringers from the stringer loader 16 is a spring-loaded actuator flap 42. The actuator flap is engaged by the leading edge of the stringers coming from the stringer loader and the actuator flap, in turn, is movably mounted so as to actuate a limit switch LS7. Also located at the forward end of the stringer feeder table 35 are the two limit switches LS10*a* and LS10*b*. The limit switches LS10*a* and LS10*b* are actuated by the leading edge of the stringer next in line to be advanced into the first nailing machine 80.**

The Deck Board Feeder

Referring to FIGS. 1, 3, 5 and 6, reference numeral 54 generally indicates a deck board feeder for containing and advancing deck boards 12 into the first nailer 80. Deck board feeder 54 comprises a table 56 that is superimposed on the stringer feeder 34. The deck board feeder table provides a platform for a magazine 58 (FIG. 3) which retains the deck boards 12 in a plurality of parallel troughs 59. Each trough maintains a stack of deck boards in spaced apart relationship and in alignment with the first nailer. At the bottom of each trough the stack of deck boards 12 is supported upon a spaced pair of horizontal support flanges **59*a* (FIGS. 9–12) extending inwardly forward each other from the side walls of the trough. At the central portion of each trough is a downwardly depending stop 60. The magazine stops are all mounted upon a transversely positioned rail 61 and extend down into the magazine troughs sufficiently far so as to retain the stacks of deck boards in place but permit the lowermost layer of deck boards to be slid out from underneath the stacks. The deck board feeder table also contains a pair of spaced feeder chains 62 having two separate deck board pusher bars 64 attached thereacross (See FIGS. 5 and 6) and spaced 180° apart on the chains. When the deck board feeder chains 62 advance, a plurality of abutment members 64*a* on one of the pusher bars engage the lowermost deck board 12 in each trough and advance them forwardly to the first nailer. The remaining overlying stacks of deck boards are retained in place by the deck board magazine stops 60. The lowermost layer of deck boards is directed into the first nailer by the side walls of the troughs 59 and the underlying support flanges 59*a*. Attached to the deck board feeder chains 62 at one of the projecting ends of each of the pusher bars 64 are two upright cams 66. As the deck board feeder chains 62 advance, the cams 66 sequentially engage overlying limit switches LS14 and LS11. The feeder chains 62 are powered by a deck board feeder motor 68 (FIG. 5) which is a conventional hydraulic motor arranged to be actuated by a pair of limit switches LS13 and LS19 within the first nailer 80 and stopped by the limit switches LS11 or LS14** as hereinafter described.

In operation, the deck board feeder 54 maintains the deck boards 12 in parallel spaced relationship and feeds them into the first nailer 80 as required. The pusher bars 64 successively engage the lowermost set of deck boards in the magazine 58 to advance the boards to the first nailer for three individual nailing operations as will be hereinafter described. The magazine 58 is continuously refilled with deck boards by an operator B (FIG. 3) who stands at the readily accessible upstream end of the magazine where the boards can be directly pushed forwardly into the magazine troughs 59.

The First Nailer, Stringer Lifting Assembly, and Pallet Index Table

Referring to FIG. 6, reference numeral 80 generally indicates a first nailing machine or nailer. The nailing machine may be any conventional industrial nailer wherein the workpiece to be nailed is conveyed horizontally to the machine and wherein a plurality of nailing heads are vertically reciprocated above the workpiece in a line, such as is shown in the prior United States patent to Richards U.S. Pat. No. 2,856,606, issued Oct. 21, 1958, for example. The nailing machine generally comprises a pair of rigid side frame members 82 which straddle a pallet index table 176 (FIGS. 3 and 4) that includes the pallet index conveyor 178. Mounted for vertical movement in the nailing machine are a plurality of nail holding chucks 81, each chuck being individually fed nails through tubes 84. The chucks (only one being shown in FIG. 6) are adjustably positioned laterally across the machine so that an entire transversely extending line of nails can be driven at the same time. The nails are forced out of the chucks and through the assembled deck boards 12 and stringers 14 by a vertically reciprocating, nail driving head 86 which is slidably mounted upon track members 88 attached to the side frame members 82 (one track member only being shown in FIG. 6). The nailing head carries a plurality of rod-like nail punches 90 which are each associated with a nail chuck and which reciprocate through the chucks to drive the nails therefrom. The nailing head is reciprocated vertically by means of a pivotally mounted drive arm 92 which is eccentrically mounted upon a large drive wheel 94 at the base of the machine. When it is desired to operate the nailing head, the drive wheel is rotated through one revolution by means of a continuously operating drive motor M1 and a drive chain 96 which powers a drive shaft 98 through a selectively energizable clutch mechanism 100. Each of the nail carrying chucks is supported upon a connecting bar 102 extending transversely across the machine, the connecting bar being also slidably supported upon the nailing machine frame members 82 in the manner of the nailing head 86. The chuck connecting bar is supported from the nailing head at each side of the machine by means of a pair of rods 104, the upper ends of which are slidably supported within the nailing head and include stop members 106. When the nailing head moves downwardly, the chucks will be carried with it until they strike the top of the structure to be nailed. The nailing head then continues its downward travel carrying the nail punches 90 through the chucks to drive the nails. During the nailing operation the stringers 14 are supported by a transversely extending anvil 108 located beneath the nail chucks and extending transversely between the side frame members 82 of the machine. For a further and more complete description of the structure and operation of the nailing machine (the details of which are not critical to an understanding of the present invention), reference is made to the hereinbefore mentioned prior United States patent to Richards U.S. Pat. No. 2,856,606.

Located on one of the side frame members 82 (FIG. 6) are a pair of spaced limit switches LS12 and LS2 which are arranged to be actuated by the vertically moving nail driving head 86 to control its movement. Limit switch LS2 is actuated when the nail driving head is in its lowermost position, and limit switch LS12 is actuated when the nail driving head has reached its uppermost position.

Figure 7:
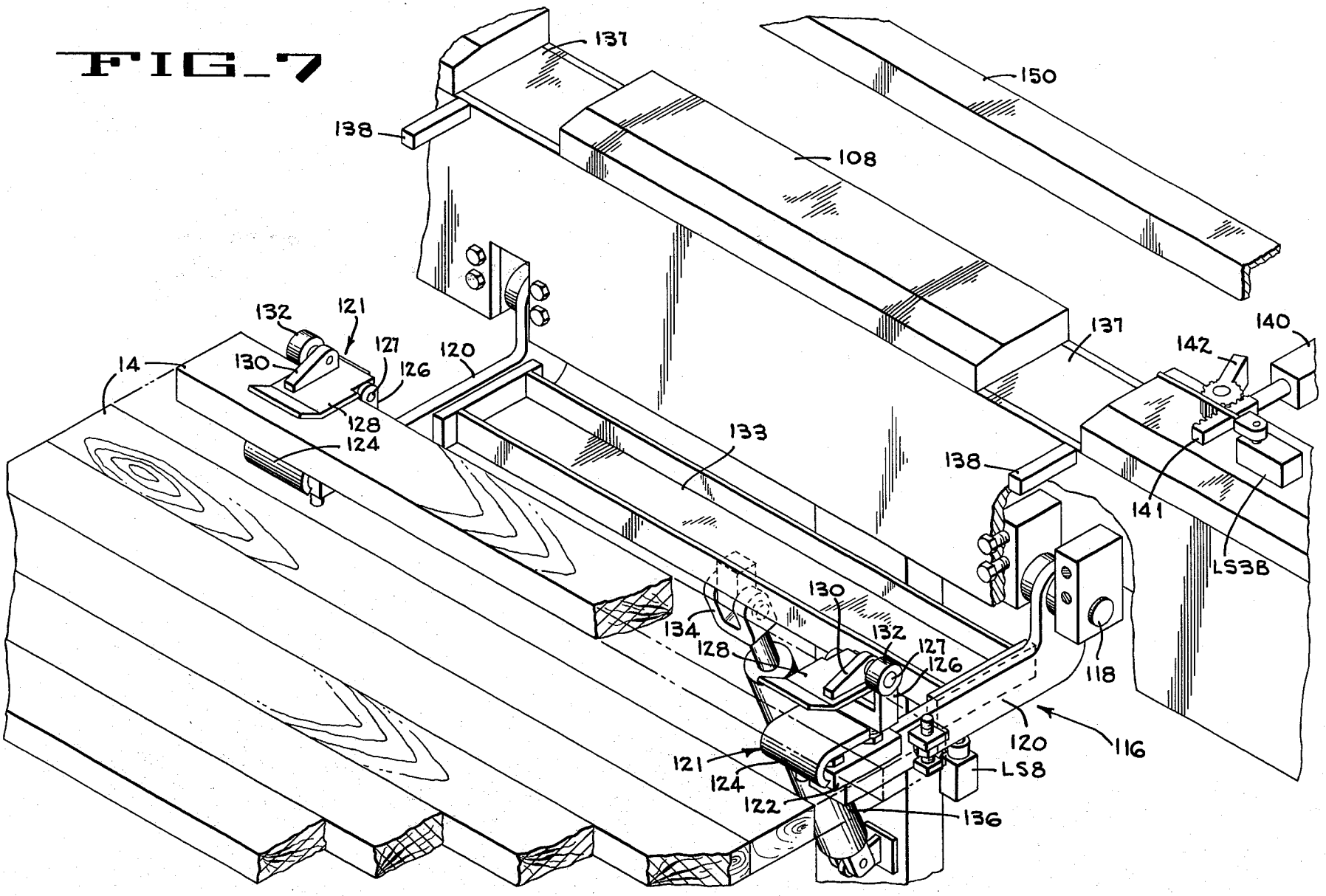
FIG. 7 is an enlarged isometric view of a portion of the nailing anvil of the first nailing machine particularly illustrating the stringer lifting assembly in its lowered or horizontal position.
Figures 8, 8A:
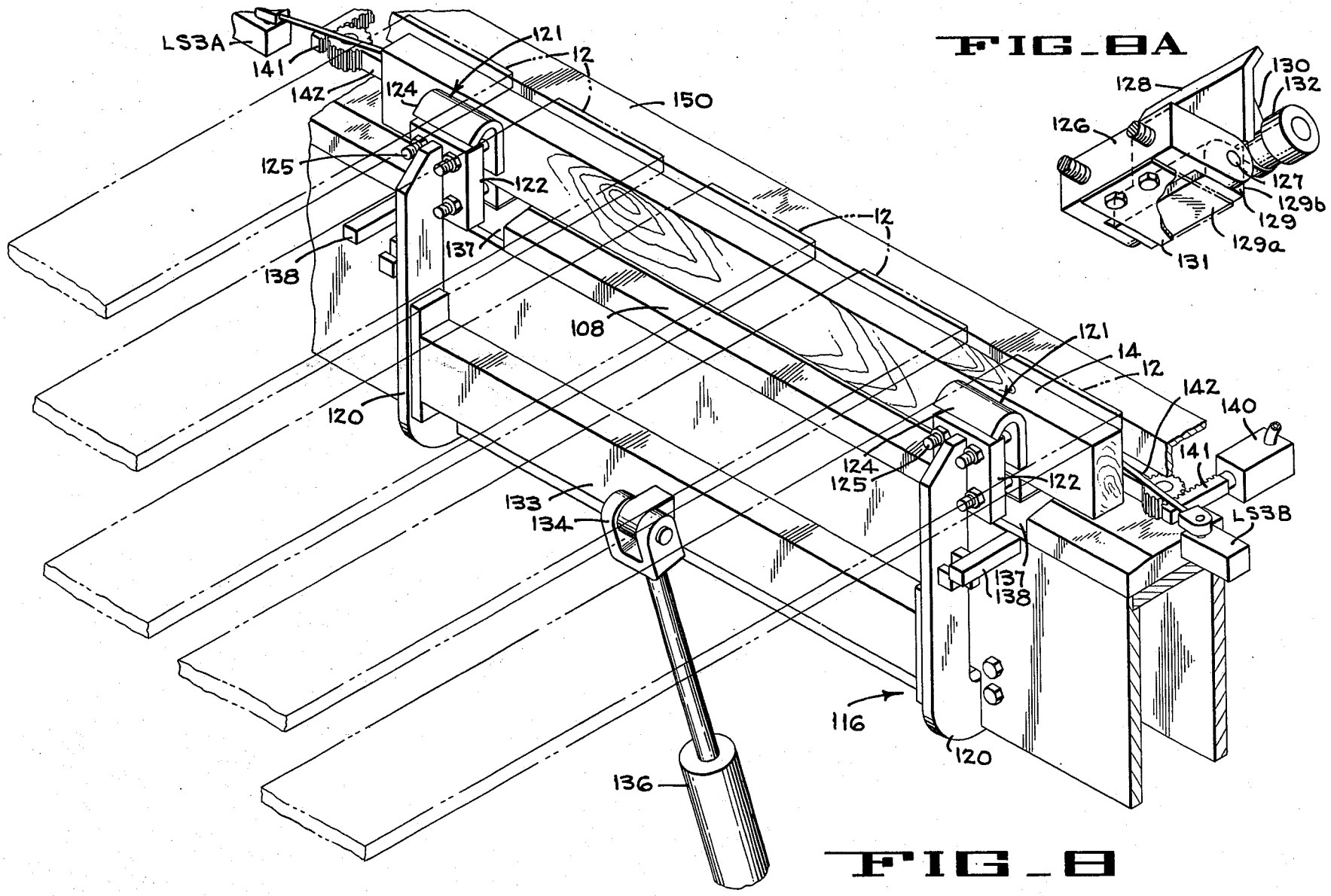
FIG. 8 is an enlarged isometric view similar to FIG. 7 but showing the stringer lifting assembly in its elevated or vertical position.
FIG. 8A is an enlarged isometric detail view of a portion of one of the pocket assemblies of the stringer lifting assembly of FIGS. 7 and 8.

Attached to the forward, input end of the first nailing machine 80 is the stringer lifting assembly 116 (FIGS. 7 and 8) which serves to individually raise each stringer 14 from the stringer feeder 34 up to the nailing surface of the anvil 108 of the nailing machine. The stringer lifting assembly includes two laterally spaced arms 120 which are pivotally connected to the frame of the first nailing machine beneath the anvil thereof by two pivot pins 118. Each arm 120 is generally L-shaped in configuration and includes a stringer pocket assembly 121 at its distal end remote from the pivot pin 118. Each stringer pocket assembly (FIG. 7) includes a base member 122 rigidly attached to the free end of the associated arm 120. Removably and adjustably secured to the base member 122 is a pocket side member 124. The pocket side member is adjustably mounted by means of a U-bolt 125 (FIG. 8) which is adjustably secured to the base member so that the pocket can be adjusted to accommodate stringers of varying thicknesses. Each stringer pocket assembly 121 also includes a U-shaped bottom support member 126 which is also adjustably bolted to the base member 122. The projecting ends of the support member 126 rotatably mount a pivot rod 127 (FIG. 8A) to which is secured a hub 128 that carries a projecting flap 128. A flat leaf spring 131 is secured by one edge thereof to the underside of the support member 126, as shown in FIG. 8A, with the free end of the spring being arranged to engage a flat surface 129*a* of the hub 129 in order to resiliently maintain the flap 128 in its stringer supporting position.

Figure 20:
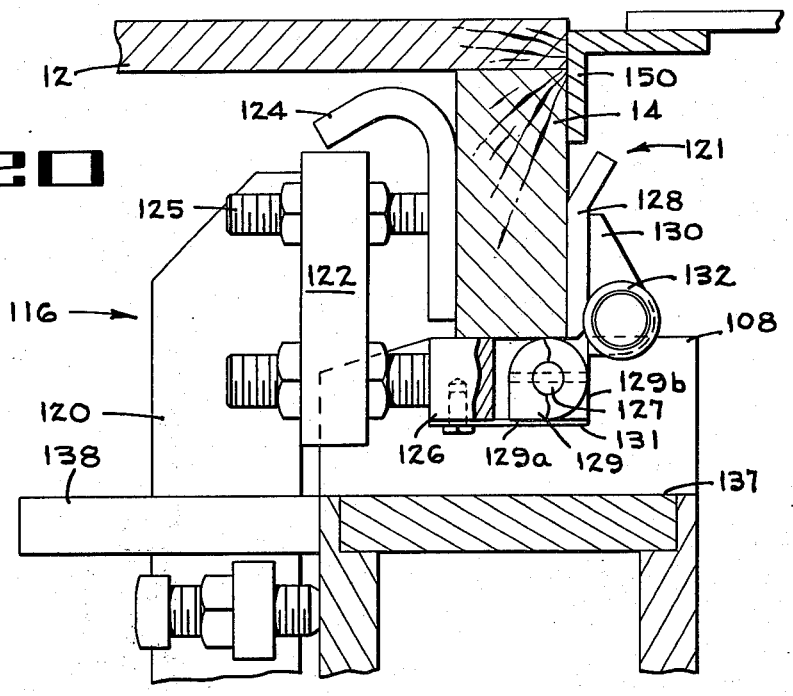
FIG. 20 is an enlarged side elevation of one of the pocket assemblies of the stringer lifting assembly of FIGS. 7 and 8, with the pocket assembly being shown in the nailing position.

Each stringer pocket assembly 121 thus provides a stringer pocket which is formed by the pocket side member 124, the bottom support member 126 and the pivotable flap 128. Rigidly mounted upon the outer side of the pivotable flap 128 (FIGS. 7, 20 and 21) is a bracket 130 which serves to rotatably mount a cam roller 132 so that the roller extends laterally of the pocket assembly in a position to be engaged by a camming bar 138 secured to the front face of the anvil 108 for moving the flap into the pocket closing position. Both of the arms 120 are rigidly held together by a cross-member 133 that causes the arms to operate together as a unit. Pivotally attached to the front face of the cross-member 133 is a clevis 134, and the piston rod of a hydraulic cylinder 136 is secured to the clevis. The hydraulic cylinder is actuated to cause the upward pivotal motion of the stringer lifting assembly 116. When the stringer lifting assembly is fully elevated by the hydraulic cylinder (FIGS. 8 and 10), each pocket assembly 121 will extend through a recess 137 in the nailing anvil 108 so that the bottom of the stringer will be received upon the upper nailing surface of the anvil.

Figure 21:
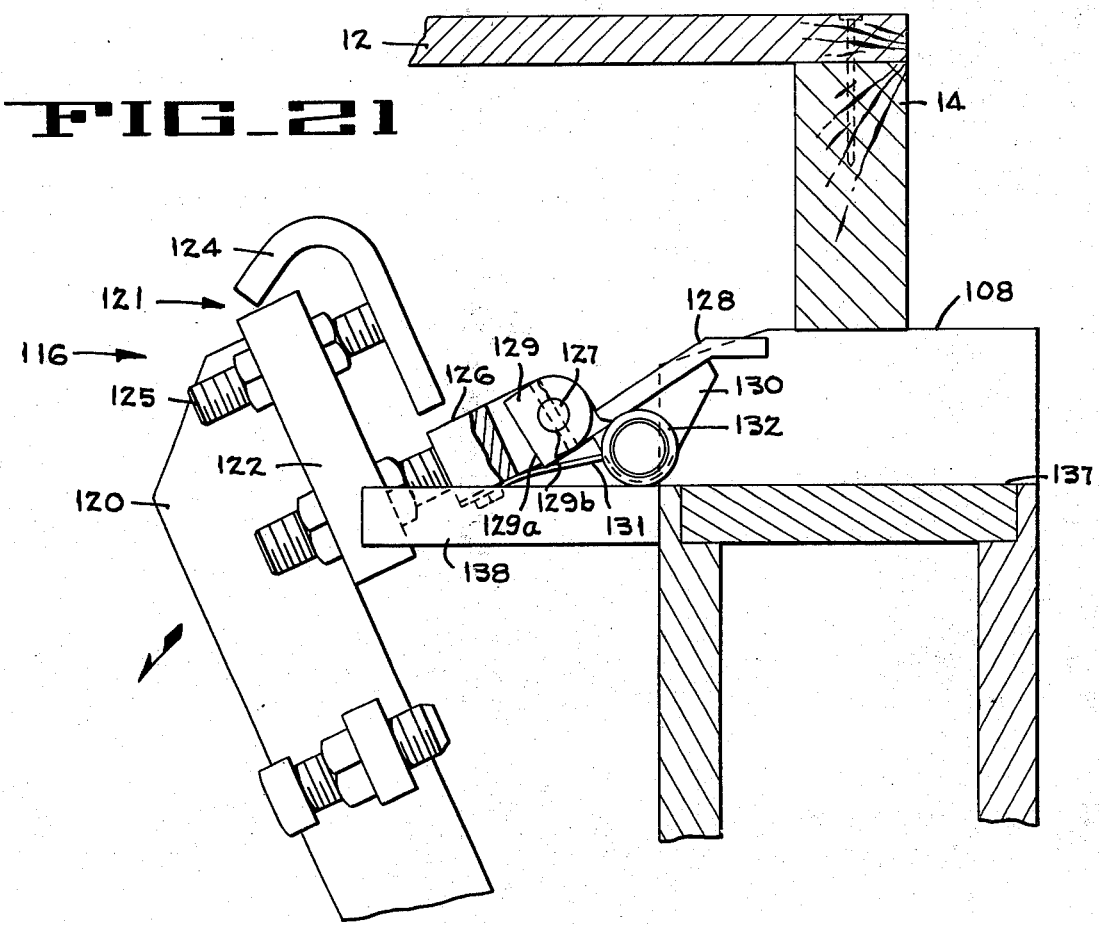
FIG. 21 is an enlarged side elevation similar to FIG. 20 but showing the pocket assembly in its opened position as the stringer lifting assembly is being pivoted downwardly.

In operation, the stringer lifting assembly 116 is rotated about a horizontal axis by the hydraulic cylinder 136. In the horizontal position, one of the arms 120 actuates limit switch LS8 (FIGS. 6 and 9) and the most forwardly located stringer 14 on stringer feeder 34 is conveyed into the pockets formed by the stringer pocket assemblies 121. Thereafter the arms 120 are elevated to the vertical position by the hydraulic cylinder. In the vertical position of the lifting assembly, the stringer will be positioned on top of the anvil 108 and the bottom support member 126 of each pocket assembly will protrude through the anvil in the associated recess 137. As the stringer lifting assembly reaches the vertical position, the stringer will activate a pair of limit switches LS3A and LS3B positioned at the sides of the anvil 108 (See FIG. 8), and (by means to be explained presently) hydraulic cylinder 140 will be shifted to retract their piston and rack assemblies 141 and rotate stops 142 into position to lock the stringer in place. After the nailing operation, the hydraulic cylinder 136 will be operated to pivot the stringer lifting assembly back to the horizontal position while the stringer 14 is retained in the nailing machine. As the stringer lifting assembly starts to move rearwardly to the FIG. 11 position, the stringer will be retained in place by the deck board feeder 54; thus, the engagement of retaining flaps 128 with the stringer will cause the hubs 129 to rotate about the axis of the pivot rods 127 until the leaf springs 131 force the hubs to snap into a 90° rotated position where each spring engages a second flat face 129*b* (FIG. 21) of its associated hub. As the snap action of the spring occurs, the flaps 128 will move from the phantom line to the fully opened full line position as shown in FIG. 11 and thereby permit the lifting assembly to be easily moved past the stationary stringer. As the lifting assembly descends, the flaps 138 will be rotated back into their pocket forming positions as the cam rollers 132 engage the camming bars 138 mounted upon the front face of the nailing machine, as shown in FIG. 21. As the rollers move along the upper flat face of the camming bars (FIG. 21), the hub 129 will be rotated until the springs 131 can again snap into engagement with the flat faces 129*a* of the hubs to bring the pocket assemblies 121 back into their stringer receiving and retaining position.

Figure 19:
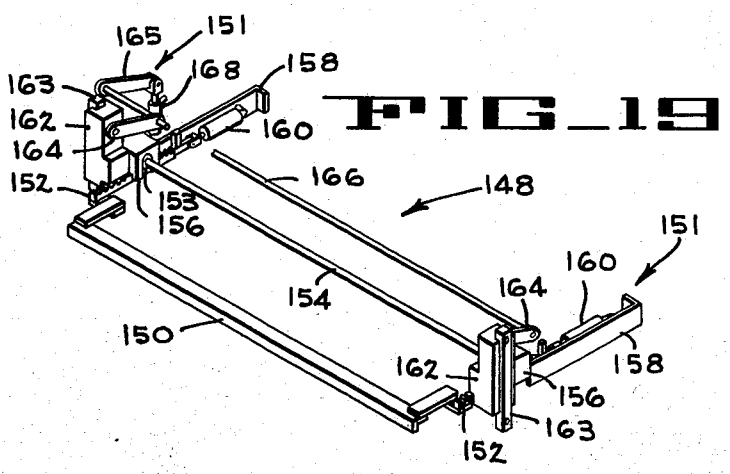
FIG. 19 is an isometric detail view of the back gauges as used in the first and second nailing machines of the pallet assembling system of the present invention.

Referring to FIGS. 9–12 and the detailed illustration of FIG. 19, reference numeral 148 generally indicates a back gauge that is supported between the side frame members 82 of the first nailing machine 80 and is used to align the deck boards with respect to the first stringer to be nailed thereto. The back gauge generally comprises a stop bar 150 and two side assemblies 151 which serve to mount the stop bar so that it extends across the nailing machine in a position parallel with and above the nailing anvil 108. The stop bar 150 is directly connected at each of its ends to a longitudinally extending rack 152. Each rack engages a pinion 153 that is mounted upon a transversely extending pinion shaft 154. The pinion shaft 154 is journalled for rotation in each side assembly 151 by means of a housing 156 that is rigidly attached to a longitudinally extending support member 158. Mounted on the support member is a hydraulic cylinder 160 that provides horizontal displacement of the associated rack 152 and, hence, the attached stop bar 150. Also rigidly attached to each of the housings 156 is a carriage 162 that is mounted for vertical travel upon a slide bar 163 secured to the adjacent side frame member of the nailing machine. Each carriage is also pivotally attached to an arm 164 through a slotted connection which permits vertical travel of the carriage upon its slide bar when the arm 164 is pivoted. Each of the arms 164 is secured to a shaft 166 that extends transversely across the nailing machine and is journalled for rotation in the side frame members of the nailing machine by suitable means (not shown). A second arm 165 is secured to the shaft 166 adjacent each end thereof, and each arm 165 is mounted for pivotal movement by a hydraulic cylinder 168 so that the shaft 166 can be rotated to raise or lower the carriages 162 and, hence, the stop bar 150. The support member 158 also mounts a limit switch LS18 which is arranged to be actuated by an actuating arm 169 (FIG. 9) that is positioned atop the rack 152. The actuating arm 169 will actuate the switch LS18 when the rack is fully retracted for a purpose to be explained presently. The trailing end of the support member 158 is arranged to actuate limit switches LS13 and LS19 in its upper and lower positions, respectively, to control the operation of the back gauge as will also be described in further detail hereinafter.

Prior to the initial positioning of the first stringer 14 and the overlying deck boards 12, the stop bar 150 is positioned above and slightly forward of the nailing anvil 108, as best illustrated in FIG. 9. When the back gauge is in the position illustrated in FIG. 9, the upper limit switch LS13 will be actuated as hereinafter described. When the nailing machine 80 is clear and ready to initiate the nailing of a pallet the back gauge 148 will be operated to move the stop bar downwardly and rearwardly to the position shown in FIG. 10. The deck board feeder 54 then drives the deck boards up to and directly against the stop bar. The stringer lifting assembly 116 is also operated to bring the first stringer 14 up to and directly against the stop bar, as illustrated in FIG. 10. After the first nailing operation has been completed, the hydraulic cylinder 160 moves the stop bar forwardly as shown in FIG. 11 while the stringer lifting assembly is moving back to its stringer receiving position. When the cylinder has fully retracted the stop bar, the hydraulic cylinder 168 will be actuated to elevate the back gauge above and out of the way of the advancing pallet, as shown in FIG. 12. The back gauge remains above and forward of the nailing anvil during the second and third nailing operations and does not return to its pallet stopping position until the start of the next nailing cycle.

Referring to FIGS. 4 and 9–12, reference numeral 176 generally indicates a pallet index table for advancing the partially completed pallet through the first nailing machine 80. The pallet index table contains the pallet index conveyor 178 which is centrally positioned between the side frame members 82 of the nailing machine and which includes a plurality of spaced lugs 179 that successively engage the stringers of the pallet as the stringers leave the nailing anvil 108. The pallet index conveyor is powered by a motor 180 (FIG. 5) which is a conventional hydraulic motor that is arranged to be started by the aforedescribed limit switch LS12 and stopped by a pair of limit switches LS17A and LS17B located on opposite sides of the pallet index conveyor (FIG. 5). Also mounted on the pallet index table are two longitudinal guides 182 (FIGS. 4 and 5) for directing the pallet through the nailing machine. The guides serve to mount the limit switches LS17A and LS17B and a further limit switch LS16 (FIGS. 5 and 6), which is positioned directly above LS17A, so that these switches will be engaged by the leading edge of the pallet when it moves into position for the second nailing operation. Also mounted on the guides 182 are two rotatable, hydraulically actuatable stops 184 (FIG. 5) which are similar to the stops 142 and which are arranged to be actuated in a similar manner. The stops 184 are arranged to swing into the path of a partially completed pallet to arrest its forward motion when a limit switch LS4 (FIGS. 5 and 6) is actuated as nailed stringer leaves the nailing anvil, and the stops are arranged to be released by the engagement of limit switch LS2, the latter action occurring at the conclusion of each nailing stroke when the nail driving head 86 contacts the limit switch LS2 and thereby releases the hydraulic stops 184 to permit the pallet to proceed forward through the nailing machine. After the second nailing operation and when the nail driving head 86 subsequently reaches the top of its stroke, the head will engage limit switch LS12 and start the pallet index conveyor motor 180 to advance the pallet. The pallet will move forward until the most recently nailed stringer 14′ engages limit switch LS4 to reposition the stops 184 in their blocking positions. The pallet continues advancing until the stringer 14′ engages the hydraulic stops and the limit switches LS17A and LS17B to stop the pallet index conveyor. The nailing machine will then be ready for the final nailing operation upon the pallet. A limit switch LS15 (FIG. 5) is positioned at the downstream end of the pallet index table for actuation by the pallet after the third nailing sequence to signal that the nailing operation by the first nailer 80 is completed and to therefore allow the half-finished pallet to pass onto the inspection conveyor 190.

The Inspection Conveyor

Referring to FIGS. 3 and 5, reference numeral 190 generally indicates an inspection conveyor where an inspector C (FIG. 3) visually inspects the partially completed pallet as the pallet emerges from the first nailer 80. At the inspection conveyor the inspector visually checks to see that all nails were properly driven and that the boards comprising the pallet are structurally sound. The inspection conveyor comprises a conveyor table 192 which mounts a pair of spaced endless conveyor chains 194 that frictionally engage the underside of the partially completed pallet to propel it from the first nailer to the turnover assembly 208. The conveyor chains are continuously driven during the pallet making operation by a conventional hydraulic motor 196. The inspector C (FIG. 3) inspects the pallets emerging from the nailer 80 while standing on a raised platform 198 which allows him ready access to the pallets. Attached to the platform and accessible to the operator is a foot bar 200 which is arranged to actuate a limit switch LS20 to stop the inspection conveyor motor 196 and allow the inspector the opportunity to remove a defective pallet.

The Turnover Assembly

Figure 13:
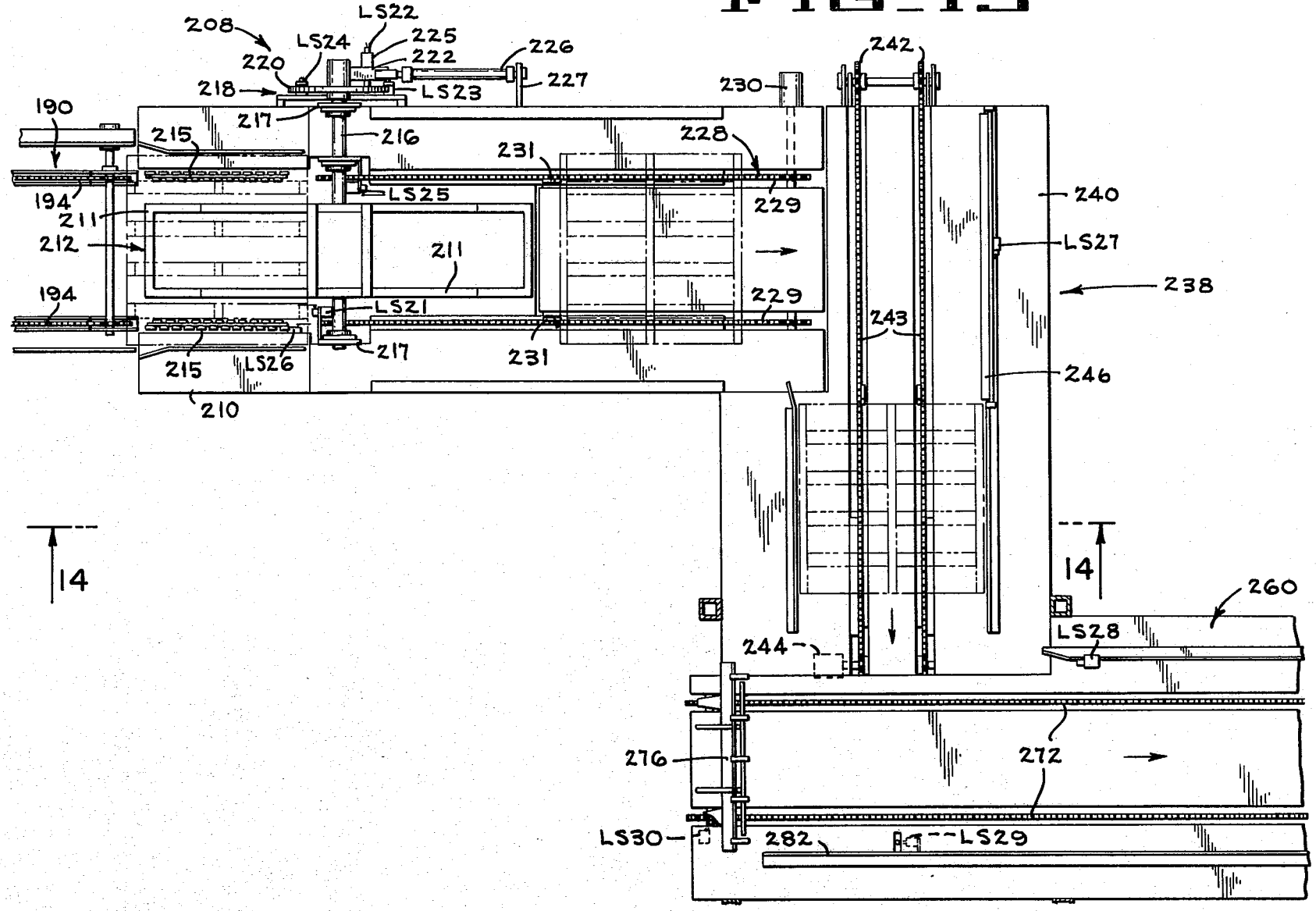
FIG. 13 is a diagrammatic plan view of the turnover assembly, the diverter, and the upstream portion of the front table at the entrance of the second nailing machine.

Referring particularly to FIGS. 13 and 14, reference numeral 208 generally indicates a turnover assembly for flipping over the partially completed pallets between the two nailing machines so that the second set of deck boards 12' can be nailed. The turnover assembly is operated to rotate the pallets in a forward direction in incremental steps of 90° rotational movement. The turnover assembly includes a table 210 upon which is mounted a turnover wheel 212 that is fabricated from four pairs of spaced frame members 211 which are connected at 90° angular intervals to a central hub 213 to form four angularly spaced pockets 214. The pockets 214 are arranged to receive the partially completed pallets and carry them over to the turnover conveyor 228. The pallets are received from the conveyor chains 194 of the inspection conveyor upon a pair of spaced sets of gravity rollers 215 (FIG. 13) which direct the pallets into one of the pockets of the turnover wheel. The hub 213 of the turnover wheel is secured to an axle 216 that is rotationally mounted to the table 210 at the opposite sides thereof by means of bearing mounts 217. Located upon one of the bearing mounts close to the axle 216 in a position to be actuated by an arriving pallet is a limit switch LS21, and a limit switch LS25 is mounted on the other bearing mount in a position to be actuated by a pallet which is received in the pocket on the downstream side of the turnover wheel just prior to its discharge.

The axle 216 of the turnover wheel is arranged to be intermittently rotated through 90° increments by an indexing wheel assembly 218 which is shown in detail in FIG. 15. The indexing wheel assembly includes an index wheel 220 which is rigidly attached to one end of the axle 216 (FIG. 13) so that it will rotate therewith. The index wheel is therefore mounted coaxially with the turnover wheel 212, and it is provided with four holes 221 spaced apart by 90° about the periphery thereof (FIG. 15). Pivotally mounted upon the axle 216 at its projecting end adjacent to the index wheel is an indexing arm 222 which includes a pin 224 slidably mounted so that it can be moved from a projecting position (FIG. 15) to a fully retracted position on the arm. The pin is arranged to be reciprocated by a hydraulic motor 225 so that it will successively engage the holes 221 in the index wheel. Mounted with a clevis assembly at the free end of the index arm 222 is a hydraulic cylinder 226. The hydraulic cylinder is attached by a bracket 227 to the turnover table 210 (FIG. 13) and is arranged to pivot the index arm through a 90° angular movement. Limit switches LS23 and LS24 are positioned to be engaged by the free end of the index arm at the ends of this angular movement to control the positioning of the retractable pin 224 so that the pin can be engaged in a hole 221 when the arm contacts LS23 (FIG. 15) and disengaged when the arm contacts LS24 after having shifted the index wheel by 90° in the desired direction. The movement of the piston rod of the hydraulic cylinder 226 is controlled by the previously mentioned limit switch LS21 which extends the piston rod and by a limit switch LS22 which is arranged to be actuated by pin 224 when it is retracted and which functions to retract the piston rod.

Also mounted on the turnover table 210 is the turnover conveyor 228 which comprises a pair of parallel spaced endless conveyor chains 229 powered by a motor 230. The conveyor chains are provided with two sets of lugs 231 (FIG. 14) spaced 180° apart to contact the pallets and move them from the turnover wheel 212 to the diverter 238. The turnover conveyor motor is started by the previously mentioned limit switch LS25, and it is stopped by a limit switch LS26 which is mounted on the turnover table 210 (FIGS. 13 and 14) adjacent the upstream end of the turnover conveyor and which is adapted to be engaged by one of the lugs 231 on the conveyor chains. The limit switch LS25 (by means to be described hereinafter) also provides an interlock to prevent the turnover wheel 212 from rotating while a pallet received in the downstream pocket of the wheel and thereby jamming such pallet between the wheel and the turnover table.

In operation, a partially completed pallet arrives from the inspection conveyor 190 and actuates the limit switch LS21, as shown in FIG. 14. The actuation of LS21 causes the hydraulic cylinder 226 to rotate the indexing arm 222 to the extended position and the pin 224, which is in engagement with the index wheel 220, will cause the turnover wheel 212 to rotate through 90°. At the end of the stroke of the hydraulic cylinder 226 the limit switch LS24 is actuated causing the pin 224 to be retracted and thus disengaging the index arm from the index wheel. After the pin has retracted it actuates the limit switch LS22 to cause the hydraulic cylinder 226 to retract until the indexing arm actuates the limit switch LS23 when it returns to its starting position. The limit switch LS23 then causes the pin to be reinserted into a hole 221 on the index wheel 220. The partially completed pallet is now in a vertical position, and the next succeeding pallet repeats the above cycle when it actuates the limit switch LS21. When a pallet is rotated down to its horizontal, flipped-over position the limit switch LS25 is actuated to start the turnover conveyor motor 230 and permit the pallet to be pulled from the turnover assembly. The conveyor motor 230 continues to run until stopped by the limit switch LS26 when the pallet has been transferred to the diverter 238.

Diverter

Referring to FIGS. 13 and 14 reference numeral 238 generally indicates a diverter for providing an offset in the work flow of the pallet making system. The purpose of the offset is to permit a single operator (not shown) to load the deck boards 12' for the second nailing machine 262 since the operator is allowed to directly slide the deck boards into the troughs of the magazine which feeds the second nailer (See FIG. 17) as will hereinafter be described in greater detail. Without an offset, two operators would be required to load the deck boards for rapid and efficient operation of the assembly system.

The diverter 238 generally comprises a table 240 having a pair of parallel spaced endless conveyor chains 242 mounted thereon. Two sets of pusher lugs 243 are spaced 180° apart on the conveyor chains for propelling the pallets along the diverter table. The conveyor chains are powered by a conventional hydraulic motor 244 (FIG. 13). Also mounted upon the diverter table 240 is a pivotable actuator plate 246 in alignment with the turnover conveyor 228 and extending parallel to the conveyor chains. The actuator plate is arranged to be engaged by a pallet which is discharged from the turnover conveyor 228 and fully received upon the diverter in order to trigger a limit switch LS27 to start the diverter conveyor motor 244. The diverter conveyor motor will be stopped when a limit switch LS29 (FIG. 13) is actuated, the limit switch LS29 being located on the front table 260 in a position to be actuated when the half-completed pallet abuts a stop plate 282 and is in alignment with the second nailer 262.

The Front Table and Second Nailer

Referring to FIGS. 13, 16A, 16B, 17 and 18, reference numeral 260 generally indicates a front table for placing the second layer of deck boards 12' upon the partially completed pallet and for directing the thus completed pallet to and through the second nailing machine 262. The second nailing machine (FIG. 16B) is positioned so as to encompass the front table in order to nail the second layer of deck boards to the pallet. Functionally attached to and integral with the front table 260 is a rear table 264 (FIGS. 16B, 17 and 18) for directing the completed pallet out of the second nailer. The rear table terminates at an inspection conveyor 266 where a second inspector (not shown) is positioned to observe the construction of the completed pallet and to remove all imperfect pallets. The pallets which are not removed by the inspector can be stacked by conventional mechanisms to await pickup and transportation to a storage area.

The front table 260 includes at its upstream end a magazine 268 (FIG. 17) that is comprised of a plurality of troughs 269 longitudinally aligned with the work flow of the pallet and each being adapted to carry a stack of deck boards. The troughs maintain the deck boards in vertical spaced stacks and have, in general, the same physical construction as the troughs 59 on the deck board feeder 54 which feeds the first nailing machine 80. Each trough includes a pair of inwardly turned flanges **269*a* (FIG. 17) that support the stack of deck boards. A vertically extending stop 270 is mounted by a transversely extending bar 271 within each trough towards the forward end of the magazine, and the stops are positioned above the bottoms of the troughs so as to permit the lowermost layer of deck boards to be slid out from underneath the stacks. The ends of the mounting bar 271 are provided with pinions 273 arranged to ride in racks 273*a* (FIG. 16A**) so that the magazine can be readily adapted for deck boards of different lengths.

Figure 16B:
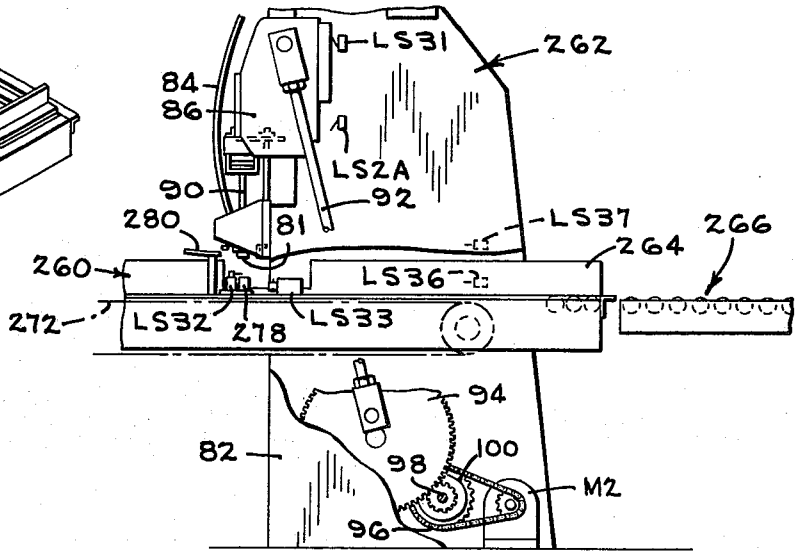
Figure 17:
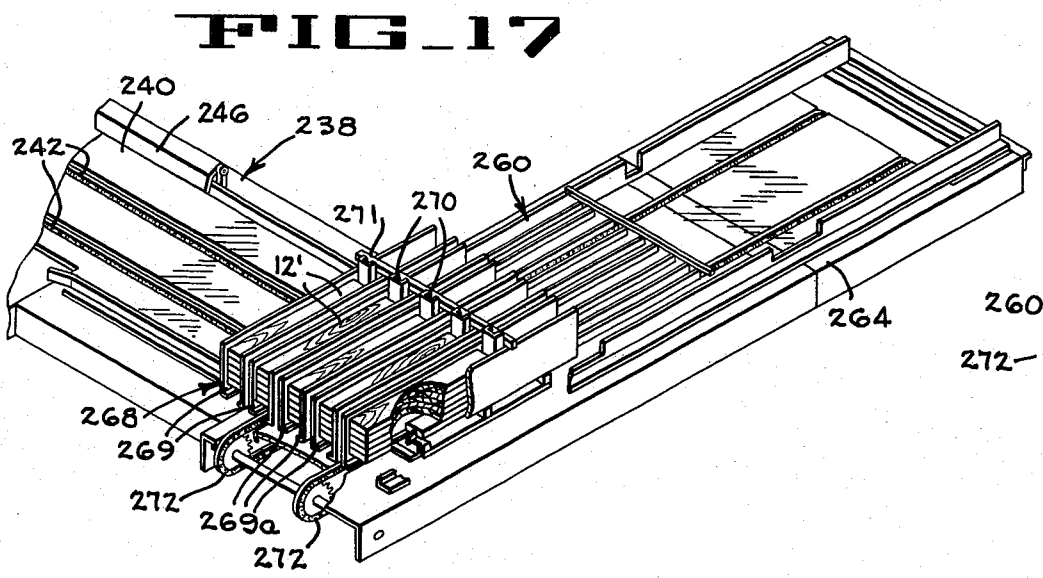
FIG. 17 is a diagrammatic perspective view of the front table of the second nailing machine particularly illustrating the manner in which the deck boards are carried so that they can be automatically fed into the second nailing machine.
Figure 18:
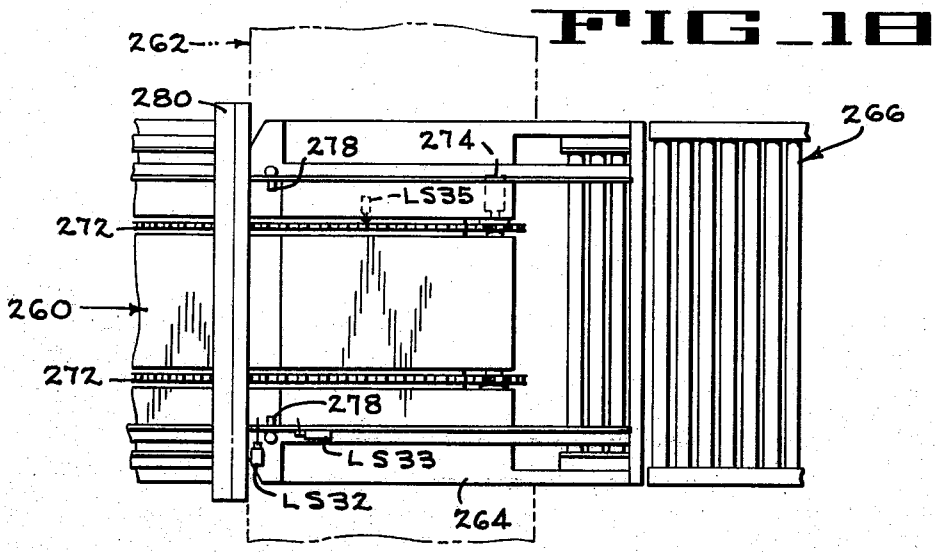
FIG. 18 is a diagrammatic plan view of the rear table which supports the pallet beneath the nailing head of the second nailing machine.

The front and rear table 260 and 264 together mount a pair of parallel spaced endless conveyor chains 272 that are used to move the pallet to and through the second nailer. The conveyor chains are driven by a motor 274 (FIG. 18) which is a conventional hydraulic motor and is arranged to be started by a limit switch LS31 on the second nailer (FIG. 16B) and the limit switch LS29 indicating that a pallet is in position at the front table. The conveyor motor is stopped by a limit switch LS32 (FIG. 18) positioned adjacent the nailing anvil on the second nailer and indicating that a stringer is in position for nailing. Mounted upon the pallet feeder chains are two pusher bars 276 which are located 180° apart. A limit switch LS30 (FIG. 13) at the upstream end of the front table 260 is engaged by one of the pusher bars 276 after the conclusion of a pallet nailing operation to signify that the pallet conveyor chains 272 are ready to initiate the nailing of the next subsequent pallet. When the partially completed pallet arrives from the diverter 238, the conveyor chains 272 will be started and the upstream pusher bar 276 will engage the lowermost layer of deck boards in the deck board magazine 268 and push this layer forwardly. As the pusher bar advances, it will also engage the half-formed pallet (as shown in FIG. 17) and both the partially completed pallet and the overlying layer of deck boards will be advanced together into the second nailer. Located on the front table just downstream from the diverter is a limit switch LS28 (FIG. 13) which is actuated when the pallet is advanced on the front table and which must be clear before the subsequent pallet can be moved onto the front table. Located on the rear table 264 and underlying the second nailer directly adjacent to the nailing anvil are two hydraulic stops 278. These hydraulic stops are generally similar to the stops 142 in the first nailer 80 and are actuated by hydraulic cylinders in a similar manner and will therefore not be described in further detail. As with the stops 142, the stops 278 are arranged to engage the front face of the stringer on the nailing anvil and thereby lock the stringer at the desired nailing location beneath the nail driving head of the second nailer. When the stops 278 are released and the pallet is moved forwardly by the conveyor chains 272, the nailed stringer will engage a limit switch LS33 which is positioned just downstream of the nailing anvil and which functions to reinsert the stops 278, as will be hereinafter further described. Immediately in front of the second nailer 262 and attached to the front table is a transversely extending deck board guide plate 280 (FIGS. 16B and 18) for retaining the deck boards against the top surfaces of the stringers in the partially completed pallet and assuming that these component parts are properly positioned just prior to nailing.

The second nailer or nailing machine 262 may comprise any conventional industrial nailer wherein the workpiece to be nailed can be conveyed horizontally through the machine and wherein a plurality of nailing heads are reciprocated vertically above the workpiece in a transversely extending line. The construction and operation of the second nailer as shown in FIG. 16B is generally the same as that of the first nailer 80 and, for the purposes of brevity, the similarities in the two nailing machines will not be redescribed. The component parts of the second nailer which are the same as those previously described component parts of the first nailer have been given the same reference numerals in FIG. 16B. The basic differences between the first and second nailers are that the second nailer does not include the stringer lifting assembly 116, the second nailer includes the rear table 264 rather than the pallet index table 176, and the second nailer does not require a second set of stops similar to the stops 184 of the first nailer. Although not shown in the drawings, the second nailer also includes a back gauge which is identical to the back gauge 148 of the first nailing machine, as shown in FIG. 19, and which is arranged to be operated in a generally similar manner. Limit switches LS36 and LS37 are utilized to signify that the back gauge is down or up, respectively, in the manner similar to that of limit switches LS19 and LS13 as previously described, and a limit switch LS34 (shown only in electrical schematic FIG. 24B) functions in the manner of the limit switch LS18 previously described. The nail driving head 86 on the second nailer actuates a limit switch LS2A at the bottom of its stroke to release the stops 278, and the nailing head actuates a limit switch LS31 at the top of its stroke to start the pallet feeder motor 274. Located on the rear table 264 and arranged to be actuated by a lug (not shown) on one of the pallet conveyor chains 272 is a limit switch LS35. This limit switch will be actuated when a pallet has been completed and has cleared the nailing area, and the switch functions to recycle the second nailing machine to cause the back gauge to return to its position adjacent the nailing anvil to receive the next subsequent pallet.

Hydraulic and Electrical Systems

Figure 22A:
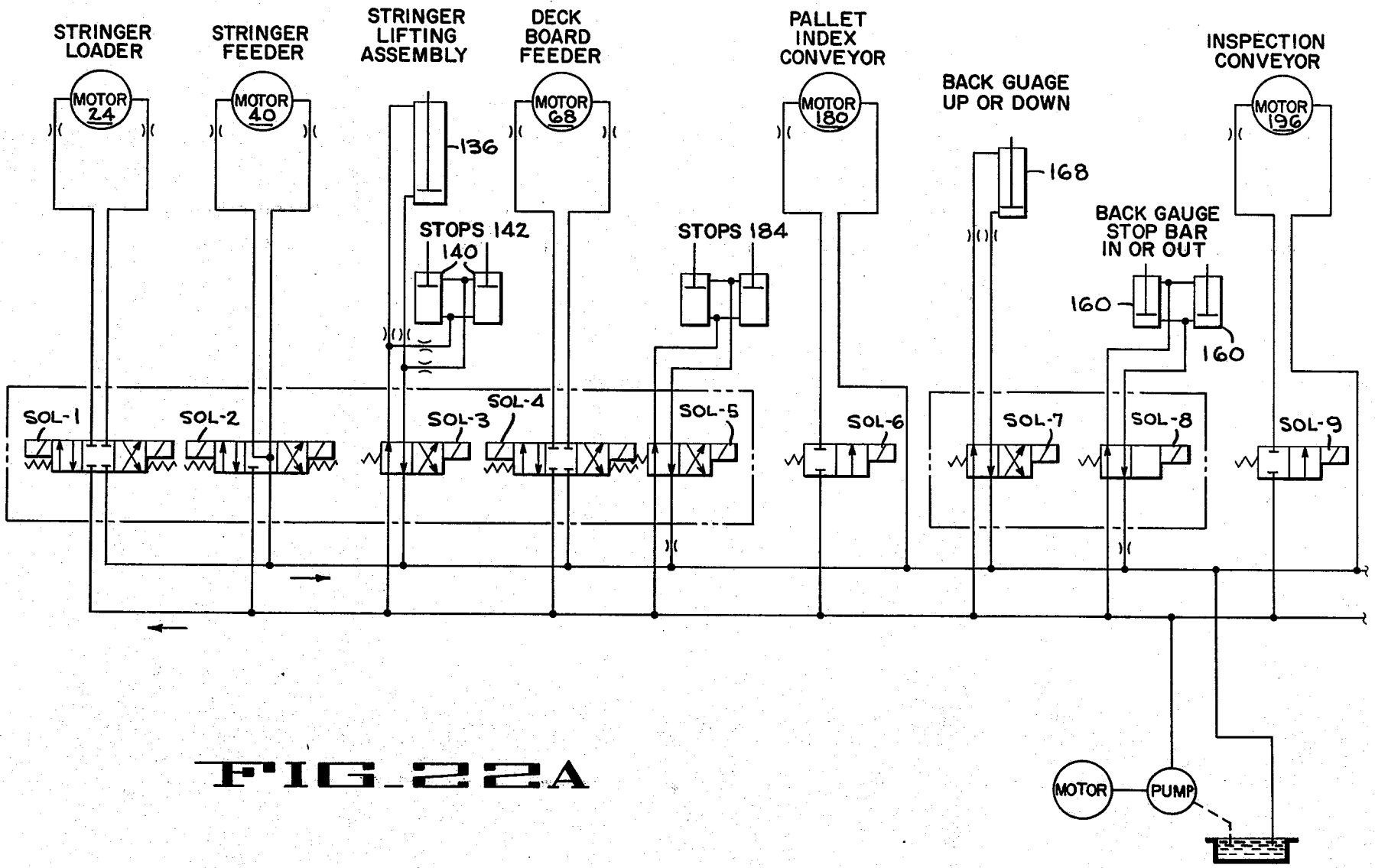
FIGS. 22A and 22B together comprise a schematic illustration of the hydraulic circuitry of the pallet assembling system of the present invention.
Figure 22B:
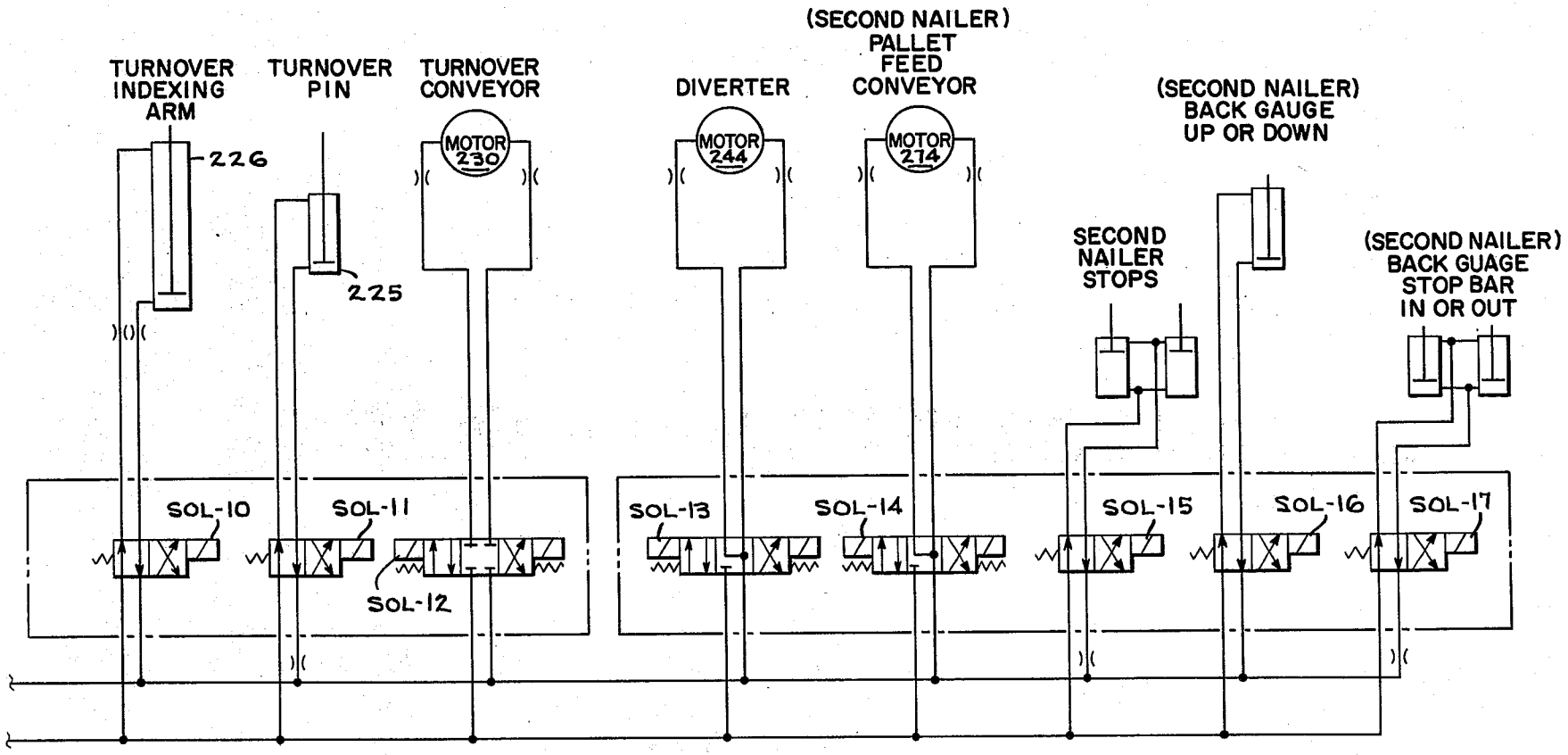

The hydraulic circuitry for the pallet assembly apparatus of the present invention is shown schematically in FIGS. 22A and 22B which are self-explanatory. It will be seen that the various hydraulic motors and hydraulic cylinders are controlled by the energization of various valve-controlling solenoids, which have been numbered SOL-1 through SOL-17. The manner in which these solenoids are energized is shown in the electrical schematic diagrams of FIGS. 23A, 23B, 24A and 24B.

Figure 23A:
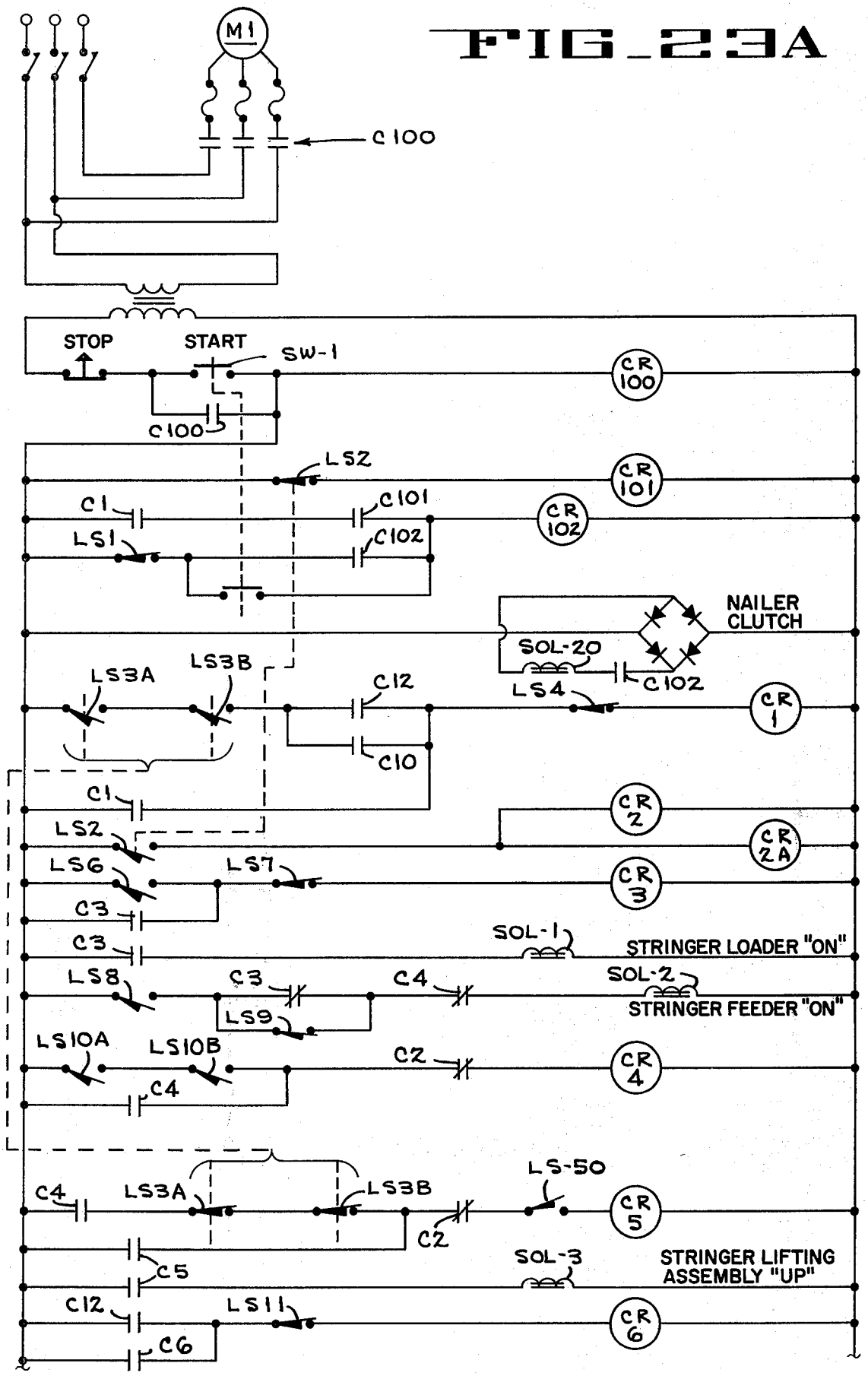
FIGS. 23A and 23B together comprise a schematic representation of the electrical circuitry for the first nailing machine and its various feed and discharge means and for the inspection conveyor.
Figure 23B:
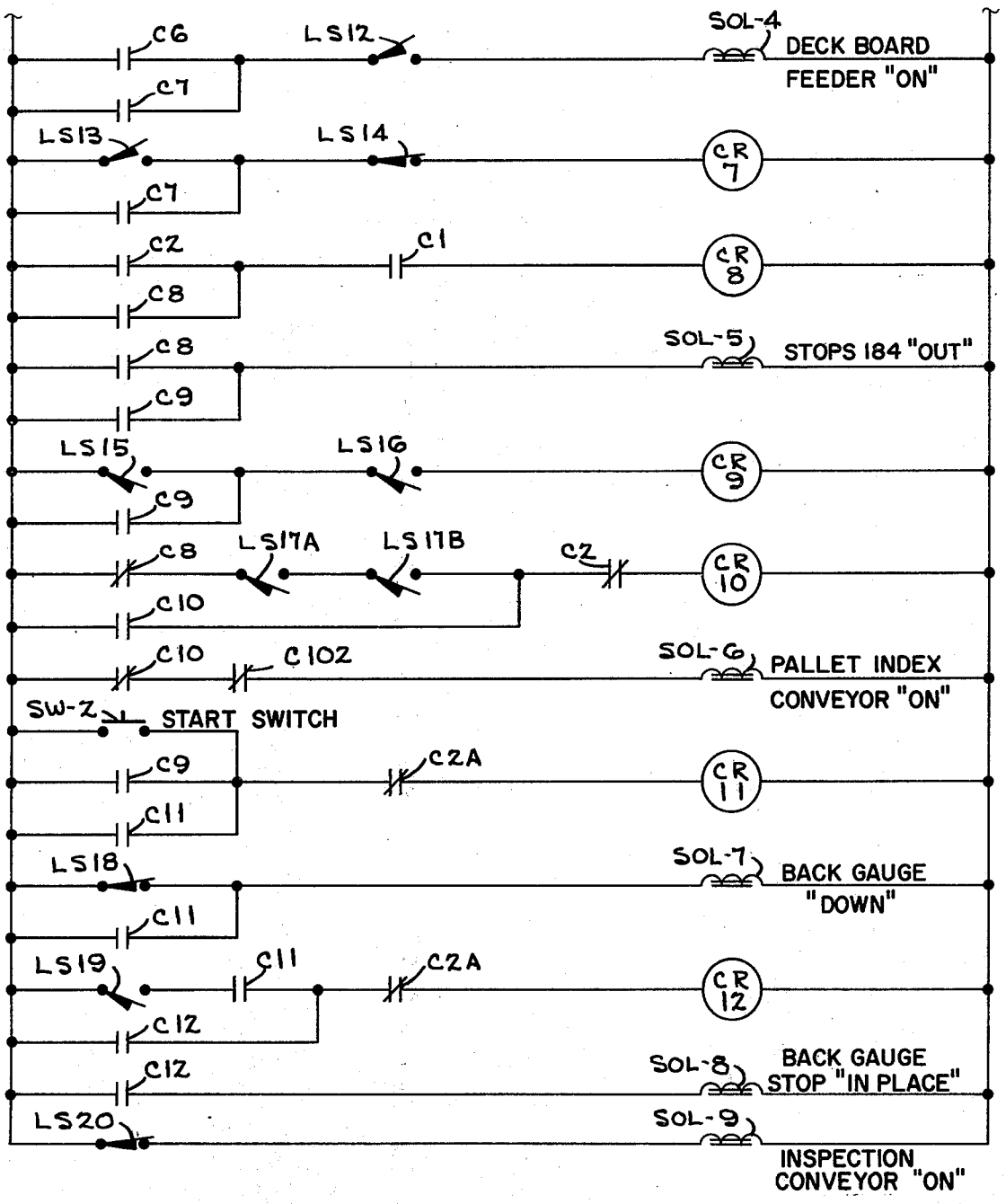
Figure 24A:
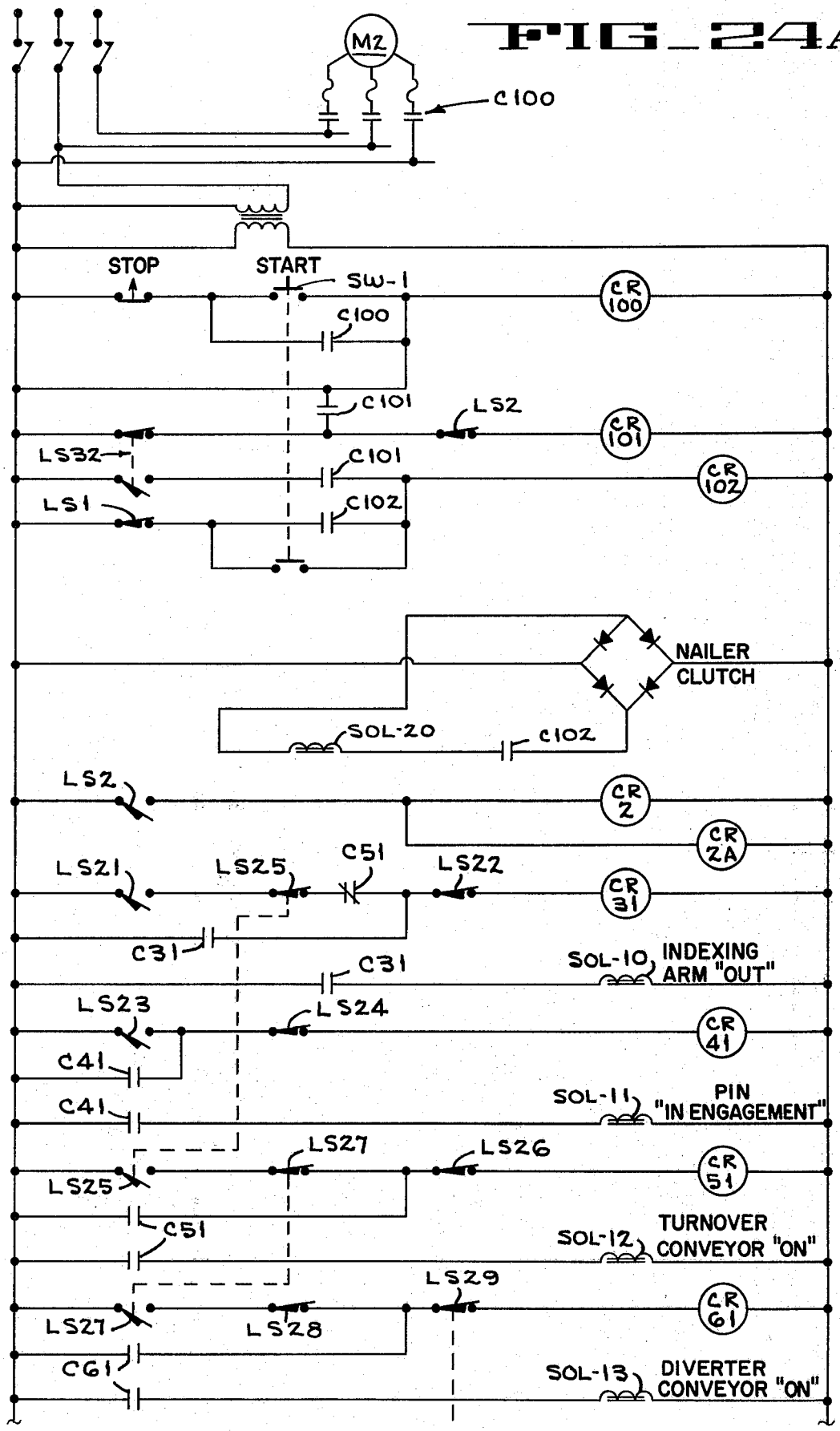
FIGS. 24A and 24B together comprise a schematic representation of the electrical circuitry for the turnover assembly, the diverter, and the second nailing machine and its feed and discharge means.
Figure 24B:
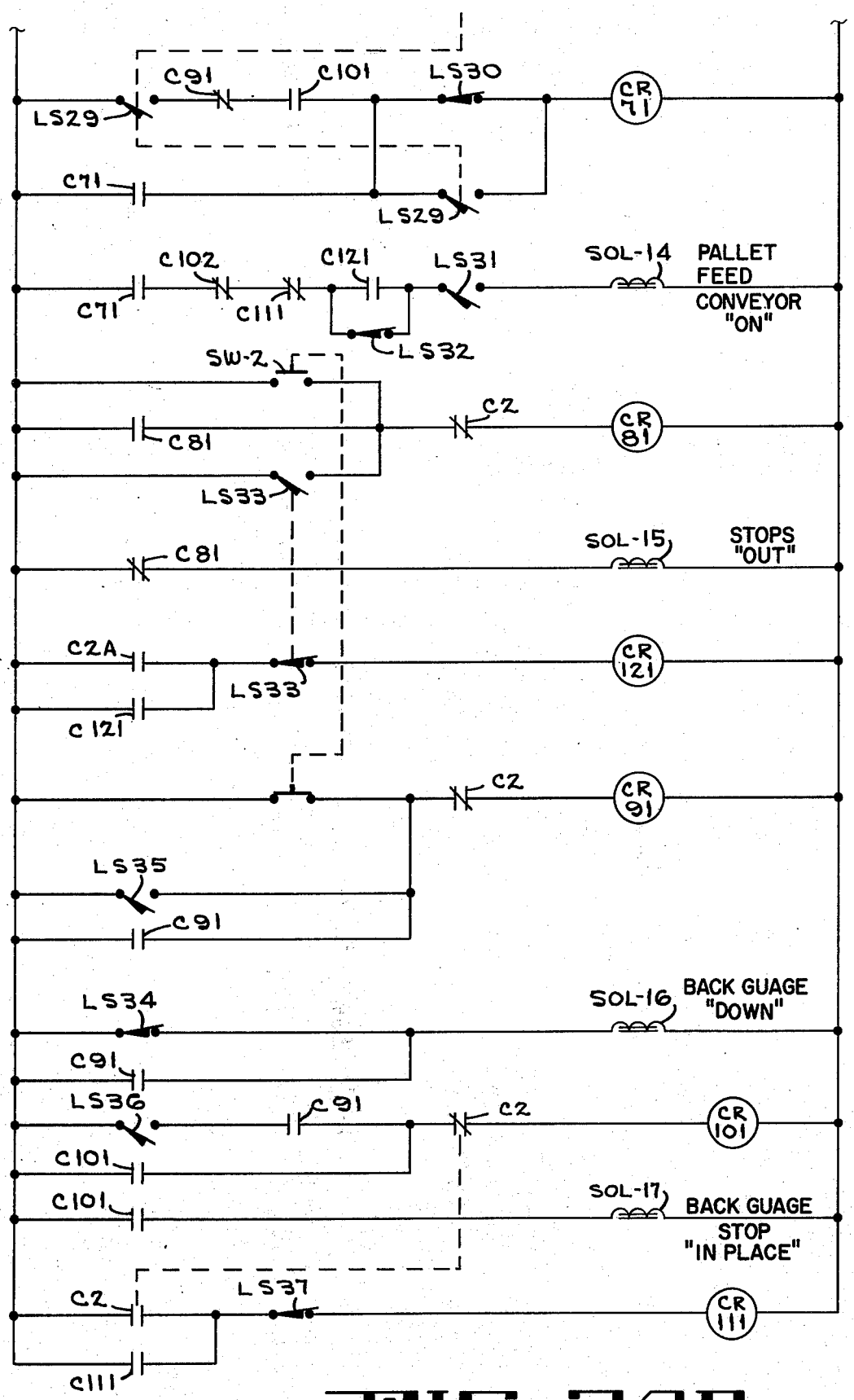

FIGS. 23A and 23B together represent the electrical circuitry for the first nailer and its feeding means and for the inspection conveyor. FIGS. 24A and 24B together represent the electrical circuitry for the turnover assembly, the diverter, and the second nailer and its feeding means. For ease in interpreting the diagrams, all relays have been given a number preceded by the prefix CR while each set of contacts is identified by a prefix C followed by a number which is the same as the relay with which such contacts are associated. The contacts are shown in their "normal" positions, i.e., the positions which they assume when their associated relays are unenergized. The detailed description of the circuitry will be given in connection with the following description of the operation of the apparatus of the present invention.

General Operation

Referring to FIGS. 23A and 23B, in particular, and FIGS. 1–22 in general, the pallet assembling operation requires that the operators initially fill the stringer loader 16 with stringers 14, the deck board feeder 54 with deck boards 12, and the front table 260 with deck boards 12'. The stringer lifting assembly 116 is down in the horizontal position, the nail driving head 86 on each nailing machine 80 is at the top of its stroke, and the back gauge 148 on each nailing machine is down with the stop bar 160 thereof in deck board blocking position adjacent to the nailing anvil 108. The operators next start the hydraulic pump (FIG. 22A) and build up pressure in the hydraulic system. Thereafter, the main circuit breakers to the electrical system are closed and the system is energized. The start switch SW-1 is closed to energize relay CR100 and start the main drive motor M1 for the first nailer 80. A normally closed limit switch LS1 (which is not shown in FIGS. 1–22, but which is actuated when LS12 is actuated with the nailing head at the top of its stroke) will be open to deenergize relay CR102 and break the circuit to the solenoid SOL-20 which engages the clutch on the nailer 80 to initiate a nailing sequence. Also, a start switch SW2 is closed temporarily to energize relays CR11 and CR12 and solenoid SOL-8 and thereby move the back gauge 148 into its blocking position.

Since the stringer lifting assembly 116 is in its lowered or horizontal position, limit switch LS8 will be closed to energize the solenoid SOL-2 to the stringer feeder motor 40 and thus start the stringer feeder chains 36. The stringer feeder chains run until one of the pusher bars 38 actuates limit switches LS6 and LS9. The closing of limit switch LS6 energizes a control relay CR3 through normally closed limit switch LS7 that stops the stringer feeder conveyor motor 40 and that energizes solenoid SOL-1 to start the stringer loader conveyor motor 24. One of the stringer loader pusher bars 22 then engages the lower layer of stringers 14 on the stringer loader table 18 and side loads the layer of stringers onto the stringer feeder 34. When the layer of stringers comes onto the stringer feeder, the forward ends of the stringers hit the actuator flap 42 and thereby open limit switch LS7 which deenergizes CR3 and stops the stringer loader conveyor motor 24. Since the limit switch LS8 is still shut, the solenoid SOL-2 is again energized and the stringer feeder motor 40 restarts to advance the layer of stringers to the stringer lifting assembly 116. Since the stringer lifting assembly 116 is in its lowered position, the first stringer will be driven directly into the pocket assemblies 121 where it will close limit switches LS10A and LS10B. Limit switches LS10A and LS10B energize a control relay CR4 that breaks the circuit to SOL-2 and stops the stringer feeder motor. It will be appreciated that the stringer loader 16 and the stringer feeder 34 operate independently of the deck board feeder 54 and the first nailer 80. The stringer loader advances stringers onto the stringer feeder whenever a stringer feeder pusher bar 38 actuates the limit switches LS6 and LS9; that is to say, the stringer loader automatically cycles every time the area directly in front of the stringer loader is clear and the layer of stringers can be pushed onto the stringer feeder.

Since the stop bar 150 of back gauge 148 is in its blocking position adjacent to the nailing anvil 108, limit switch LS19 will be closed. Since the nail driving head 86 is at the top of its stroke, the limit switch LS12 is closed to condition to solenoid SOL-4 for energizing the deck board feeder. The relay CR11 having been previously energized through SW-2, relays CR12 and Cr6 will be energized. The limit switch LS12 insures that the nail driving head is at the top of its stroke and that the nail driving area is therefore clear. If all of the above conditions are satisfied, the solenoid SOL-4 is energized through C6 and LS12 and the deck board feeder chains 62 advance the layer of deck boards from the deck board magazine 58 forwardly to the first nailer. The deck board feeder motor 68 runs until a dog 66 (FIG. 6) actuates limit switch LS11. The limit switch LS11 indicates that the deck boards have traveled forward far enough so that the leading edges rest against the stop bar 150 at the first nailer. The opening of limit switch LS11 deenergizes the relay CR6 and thereby breaks the circuit to SOL-4 to stop the deck board feeder motor 68. The deck boards 12 are thus in position for the first nailing operation, and a limit switch LS50 (FIGS. 5 and 6) that is positioned adjacent to the nailing anvil will be closed by the leading edge of the deck boards to condition the stringer lifting assembly circuitry.

Since the first stringer is resting in the pocket assemblies 121 of the stringer lifting assembly 116, the limit switches LS10A and LS10B are closed and relay CR4 is energized. The relay CR4, in turn, energizes a relay CR5. When the relay CR5 is energized the solenoid SOL-3 is energized and the stringer lifting assembly 116 is raised vertically to bring the first stringer 14 into position on the nailing anvil 108 in alignment with the overlying deck boards.

When the stringer lifting assembly 116 reaches the vertical position, the limit switches LS3A and LS3B are actuated. Since the stop bar 150 is down and providing a stop for the forward end of the pallet, the limit switch LS19 is closed and the relay CR12 is energized. This completes a circuit through LS3A, LS3B, C12 and LS4 to energize a relay CR1. The relay CR1 thus is energized when the back gauge is in its blocking position, the deck boards are at the nailing anvil, and a stringer is in position below the deck boards. Thus, the relay CR1 is energized when all of the conditions precedent for a nailing operation are satisfied. The relay CR1 energizes the relay CR102 that energizes SOL-20 and engages the clutch mechanism 100 on the first nailer. The clutch mechanism 100 connects the drive motor M1 to the drive arm 92 and the nail driving head 86 begins its downward stroke. At the bottom of the nailing stroke the nail driving head 86 actuates the limit switch LS2. The actuation of limit switch LS2 energizes the relay CR2 and thereby deenergizes the relay CR5 by opening a normally closed contact C2. The deenergization of relay CR5 breaks the circuit to SOL-3 and causes the stringer lifting assembly 116 to return to its lowered position at the stringer feeder 34. When the hydraulic cylinder 136 is thus retracted, the stringer pocket flaps 128 rotate about their pivot axis and pass beneath the stringer and through the pockets 137 in the nailing anvil 108. After the flaps 128 pass beneath the stringer, the cam rollers 132 engage the cam fingers 138 which force the flaps to return to their pocket-forming configurations.

The actuation of limit switch LS2 (at the bottom of the nailing stroke) also energizes the relay CR2A that deenergizes the relay CR12 and thereby breaks the circuit to SOL-8 to cause the back gauge hydraulic cylinders 160 to retract and move the stop bar 150 horizontally forward into the nailer. When the hydraulic cylinders 160 have been fully retracted, the limit switch LS18 opens. The energization of relay CR2A also deenergizes the relay CR11 and the circuit to SOL-7 is thus broken so that the hydraulic cylinder 168 is operated to retract and thereby raise the back gauge up and out of the way of the pallet where it will remain for the second and third nailing operations on the pallet.

Finally, the actuation of limit switch LS2 (at the bottom of the nailing stroke) deenergizes relay CR101 to open contact C101 and condition the relay CR102 to disengage the clutch 100 when the nailing head reaches its upper position again.

When the stringer lifting assembly 116 returns to the horizontal position in front of the stringer feeder 34, the limit switch LS8 is again closed thereby starting the stringer feeder conveyor motor 40 and pushing a second stringer 14' into the stringer pocket assemblies 121. When the second stringer enters the stringer pocket assemblies, the limit switches LS10A and LS10B will be closed to energize the relay CR4 to break the circuit to SOL-2 and stop the stringer feeder conveyor motor. In summary, each time that the stringer lifting arm cycles downward to the horizontal position in front of the stringer feeder 34, the stringer feeder conveyor will automatically be operated to push a stringer into the stringer pocket assemblies 121.

When the back gauge 148 reaches its upper position and the hydraulic cylinder 168 is fully retracted, the limit switch LS13 is closed. The limit switch LS13 will, in turn, energize the relay CR7 through the normally closed limit switch LS14. When the nailing head 86 reaches the top of the stroke, the limit switch LS12 closes, indicating that the nailing area is clear. This completes a circuit to SOL-4 and starts the deck board feeder motor 68 which pushes the pallet forwardly into the nailer. The deck board pusher 64 transports the pallet forwardly for a short distance and then it passes beneath the trailing ends of the deck boards. The deck board feeder chains 62 continue to run until a dog 66 on the next deck board pusher 64 actuates the limit switch LS14 to deenergize the relay CR7 and stop the deck board feeder motor. It will be noted (from FIG. 22A) that the lowering of the stringer lifting assembly by deenergization of SOL-3 also causes the stops 142 to be retracted to permit the pallet to be pushed forward in the nailer.

As soon as the pallet has moved forward and cleared the nailing anvil 108, the limit switches LS3A and LS3B close to energize the relay CR5, and the stringer lifting assembly 116 will be conditioned to raise the second stringer 14' into place on the nailing anvil. As the first stringer moves out of the nailing area it engages limit switch LS4 to deenergize relay CR1 which, in turn, deenergizes relay CR8 to break the circuit to solenoid SOL-5 and move the stop 184 out into their blocking positions.

After the pallet has been pushed forward into the nailer by the deck board feeder chains 62, the first stringer will be in a position to be engaged by one of the lugs 179 on the pallet index conveyor 178. The pallet index conveyor has been running since the startup of the pallet making machine (except during the nailing cycle). The pallet index conveyor catches the stringer 14 and pulls the pallet forwardly until the stringer hits the stops 184. Simultaneously with hitting the stops, the pallet actuates limit switches LS17A and LS17B that energize the relay CR10 to break the circuit to SOL-6 and stop the pallet index conveyor.

The second nailing operation is commenced if the second stringer 14′ is in place on the nailing anvil 108 and the limit switches LS3A and LS3B are actuated to condition relay CR1. In addition, the relay CR10 must be energized indicating that the first stringer and the overlying deck boards have been advanced to the second nailing position. If these conditions are satisfied, then the relay CR1 is energized to, in turn, energize the relay CR102 and cause the clutch mechanism 100 on the nailing machine to engage the motor M1 to the drive arm 92 of the nailer. When the nail driving head 86 reaches the bottom of its stroke, the limit switch LS2 closes and energizes relays CR2 and CR2A. As hereinbefore described, these relays cause the stringer lifting assembly 116 to return to its lowered position in front of the stringer feeder to pick up the next stringer after the stringer feeder 34 indexes forward. Also occurring at the bottom of the nailing stroke is the energization of relay CR8 through closed contacts C1 and C2. This energizes solenoid SOL-5 to retract the stop 184 from their blocking positions.

At the top of the nail driving stroke the limit switch LS1 again opens, and the relay CR102 is deenergized. When the relay CR102 is deenergized, the solenoid SOL-6 is energized and the pallet index conveyor 178 is started. Since the stops 184 are retracted out of the way of the first stringer, the pallet will move forwardly through the nailing machine. As soon as the second stringer 14′ leaves the nailing anvil 108, the limit switches LS3A and LS3B are released to energize the relay CR5, and the stringer lifting assembly 116 cycles down to pick up the third stringer—as hereinbefore discussed. The movement of the second stringer forwardly also actuates the limit switch LS4 to deenergize the relay CR1 that, in turn, deenergizes the relay CR8. Limit switch LS4 is so positioned that, upon energization of CR8, the stops 184 return to their blocking positions to block the passage of the second stringer 14′ after the first stringer 14 has passed. When the stops 184 engage the second stringer 14′, the limit switches LS17A and LS17B are closed to thereby stop the pallet index conveyor 178 as hereinbefore described.

The third nailing cycle is commenced if the third stringer 14″ is in place at the nailing anvil 108, if the limit switches LS3A and LS3B are actuated, and also if the relay CR10 is energized indicating that the partially nailed pallet has been advanced the proper distance. If these conditions are met, then the relay CR1 is again energized to, in turn, energize the relay CR102 that causes the engagement of the clutch mechanism 100 of the nailing machine. At the bottom of its stroke the nail driving head 86 actuates the limit switch LS2 that energizes relays CR2 and CR2A. These relays cause the stringer lifting assembly 116 to cycle down to pick up the first stringer for the next subsequent pallet, but the assembly 116 will not be elevated until the deck boards for the next pallet are in place to actuate LS50. Also at the bottom of the nail driving stroke, the relay CR8 is energized to release the stops 184 thereby permitting the half-formed pallet to be moved by the pallet index conveyor 178 when it is started at the top of the nail driving stroke by the opening of the limit switch LS1.

The completed pallet moves forward out of the nailer and onto the inspection conveyor 190. As the pallet passes out of the nailer, the pallet will simultaneously actuate both of the limit switches LS15 and LS16. The relay CR9 is thereby energized to, in turn, energize the relay CR11. This completes a circuit to solenoid SOL-7 to cause the hydraulic cylinder 168 to extend and to move the back gauge downwardly. When the back gauge is in its lowermost position, the limit switch LS19 closes thereby energizing the relay CR12 to cause the hydraulic cylinders 160 to extend and move the stop bar 150 horizontally toward the nailing anvil 108. The limit switch LS16 keeps the stops 184 from engaging the end stringer 14″ and allows the completed pallet to pass out of the nailer. The pallet assembling cycle as hereinbefore described then repeats automatically. The inspector stationed on the platform 198 at the inspection conveyor observes the emerging pallet for defects. If the inspector observes a defect, he manually stops the inspection conveyor with the foot bar 200 that opens the limit switch LS20 and breaks the circuit to solenoid SOL-9.

The power supply circuit for the turnover assembly 208, the diverter 238, and the second nailer 262 is illustrated in FIGS. 24A and 24B. The operation and control of the second nailer is similar to that of the first nailer 80. The limit switches and relays that are identical in both nailing machines have been given common reference numerals, and their operation and function will not be redescribed in any great detail. The power supply circuit for the second nailer is energized by closing switch SW-1 and switch SW-2 for the purposes hereinbefore described.

After the partially completed pallet leaves the inspection conveyor 190, it will arrive at the turnover assembly 208. At the turnover assembly the pallet is turned end-for-end so that the nailed deck boards 12 that were previously on top of the stringers leave the turnover assembly positioned below the stringers. At the "start" position of the turnover assembly (i.e., awaiting the entry of a pallet), the hydraulic cylinder 226 is fully retracted and limit switch LS23 is actuated to energize a relay CR41 that engages the pin 224 in the index wheel 220.

When the half-formed pallet enters a pocket 214 in the turnover wheel 212, it will actuate limit switch LS21. The limit switch LS21 energizes a relay CR31, and relay CR31 causes the hydraulic cylinder 226 to extend its operating arm. Since the operating arm of the hydraulic cylinder 226 is connected to the index wheel 220 by the engaged pin 224, the motion of the arm turns the indexing wheel assembly 218 and, hence, the turnover wheel 212. When the operating arm of hydraulic cylinder 226 is fully extended, the turnover wheel is rotated 90°, and the indexing arm 222 will actuate limit switch LS24. The opening of limit switch LS24 deenergizes relay CR41 and thereby causes the pin 224 to retract. When the pin retracts, the hydraulic cylinder 226 is disengaged from the index wheel 220. In addition, when the pin retracts it will actuate a limit switch LS22 and deenergize relay CR31 which, in turn, causes the operating arm of hydraulic cylinder 226 to retract back to its initial position. The index wheel 220 does not rotate when the arm of cylinder 226 retracts since the pin has been retracted. At this time the turnover wheel 212 is arranged to be held in place by a spring loaded detent (not shown). When the operating arm of the hydraulic cylinder 226 is fully retracted, the limit switch LS23 is again actuated to energize relay CR41 and reinsert the pin 224 into the index wheel 220. At this point the partially completed pallet has been rotated 90° and is now in a vertical position as illustrated in FIG. 14.

When the next pallet arrives at the turnover assembly 208 from the inspection conveyor 190, it will actuate the limit switch LS21 and the hereinbefore described pallet turnover cycle will be repeated to rotate the first pallet an additional 90° to its flipped-over position and the second pallet a preliminary 90° to a vertical position. When the first pallet has therefore been rotated 180° (after two cycles of the hydraulic cylinder 226), it will actuate limit switch LS25. The limit switch LS25 energizes a relay CR51 through normally closed switches LS27 and LS26 and completes a circuit to solenoid SOL-12 to start the turnover conveyor motor 230. The turnover conveyor pulls the first pallet out of the turnover wheel 212 and ejects it onto the diverter 238.

When the pallet reaches the diverter table 240, it engages the actuator plate 246 and actuates the limit switch LS27. There is an interlock in the circuit to prevent pallets from piling up on the diverter. If there is a pallet already on the diverter and actuating the limit switch LS27, the relay CR51 cannot be energized through LS25 thereby preventing the turnover conveyor motor 230 from running. There is also a second interlock in the turnover conveyor circuit to prevent the turnover wheel 212 from rotating when a pallet rests in the discharge pocket of the wheel since, if the wheel were rotated with a pallet in the discharge pocket, the pallet would be crushed between the wheel and the turnover conveyor 228. To prevent this situation from occurring, the limit switch LS25, when actuated, opens the circuit to the relay CR31 and a normally closed contact C51 maintains the circuit open while the turnover conveyor is running to prevent the actuation of the hydraulic cylinder 226. It will thus be seen that the energization of relay CR51 indicates that the turnover conveyor is running and in the process of pulling a pallet from the turnover wheel. Thus, when both the limit switch LS25 is unactuated and the relay CR51 is unenergized, the turnover wheel will be ready to be indexed again.

The turnover conveyor 228 transports the pallet from the turnover wheel 212 to the diverter 238 as previously pointed out. When one of the sets of pusher lugs 231 of the turnover conveyor has transported the pallet onto the diverter, the other set of lugs will temporarily actuate a limit switch LS26 to deenergize the relay CR51 and stop the turnover conveyor motor 230 until it can be restarted through switch LS25. When the pallet engages the actuator plate 246 on the diverter 238 and actuates the limit switch LS27, a circuit is completed through LS28 and LS29 to energize a relay CR61 that starts the diverter conveyor motor 244. If there is a pallet on the front table 260 of the second nailer 262 and actuating the limit switch LS28, the diverter conveyor motor will not start until after the pallet has cleared the limit switch LS28 and allowed it to close. The diverter conveyor chains 242 will run until the pallet is in position on the front table 260 in alignment with the second nailer when it will engage and actuate limit switch LS29. The limit switch LS29 breaks the circuit to relay CR61 and deenergizes the diverter conveyor solenoid SOL-13.

The second nailer 262 operates in generally the same manner as the first nailer, and, for the purposes of brevity, the precise operation of the second nailer will not be redescribed. At start-up the second nailer 262 will await the first pallet with its back gauge in the "down" position and actuating a limit switch LS36. The nail driving head 86 will be at the top of its stroke and actuating limit switches LS1 and LS31. The second set of deck boards 12′ are placed in the deck board magazine 268. By pushing the switch SW-2, a relay CR91 is energized, and the relay CR91 energizes a relay CR101 through closed limit switch LS36. The limit switch LS29 and energized relay CR101, in turn, energize a relay CR71 which closes a circuit through the closed limit switch LS31 to energize the pallet feed conveyor motor 274. Thus, when the pallet is in place and the nailing area is clear, the pallet feeder chains 273 will advance the pallet and a layer of deck boards from the deck board magazine 268 toward the second nailer. When the pallet and the superimposed deck boards arrive at the stop bar 150 of the back gauge, the pallet will actuate a limit switch LS32 that deenergizes the pallet feed conveyor motor 274 and stops the conveyor chains 272. Also, when the limit switch LS32 is actuated, the relay CR102 will be energized through closed contact C101. The relay C102 will engage the clutch mechanism 100 between the motor M2 and the nail driving head 86. Thus, the limit switch LS32 cycles the second nailing machine.

At the bottom of the nail driving stroke, the nail driving head 86 actuates the limit switch LS2 that energizes relays CR2 and CR2A. The energization of relay CR2 de-energizes relay CR81, and this, in turn, causes the energization of solenoid SOL-15 which operates to retract the stops 278 out of the way of the pallet when it subsequently advances. The energization of relay CR2 also de-energizes the relays CR91 and CR101 and energizes the relay CR111. De-energization of relay CR101 retracts the operating arms of the hydraulic cylinders 160 on the back gauge to pull the stop bar 150 forwardly away from the nailing anvil 108. When the operating arms of the hydraulic cylinders 160 have fully retracted, the limit switch LS34 is actuated. This de-energizes SOL-16 to cause the operating arm of the hydraulic cylinder 168 to retract and to pivot the back gauge upwardly. When the back gauge is up and out of the way of the pallet, the limit switch LS37 is actuated which de-energizes a relay CR111 which conditions the circuit to the solenoid SOL-14 to permit the pallet feed conveyor to be started.

When the nail driving head 86 returns to the top of its stroke, it will actuate the limit switch LS31 to start the pallet feed conveyor again once the back gauge is clear. Since the nail driving head is at the top of its stroke and the stops 278 have been retracted the pallet may move forward without obstruction. After the first stringer of the pallet has moved off of the nailing anvil 108, it will actuate the limit switch LS33 to energize the relay CR81 and reset the stops 278. The hydraulic stops extend into the path of the advancing pallet and engage the first stringer in the manner described hereinbefore with respect to the first nailer. As the first stringer of the pallet engages the stops, the second stringer of the pallet engages the limit switch LS32. As hereinbefore described, limit switch LS32 cycles the second nailer and triggers each nail driving stroke. After the second nailing operation the pallet is advanced by the actuation of the same sequence of limit switches and relays as hereinbefore described. The pallet is stopped under the nail driving head for the third nail driving operation when the stops 278 engage the second stringer. The third stringer on the pallet actuates the limit switch LS32, and the third nail driving cycle, as hereinbefore described, is repeated.

After the third nailing operation, the fully nailed pallet is moving forwardly on the conveyor chains 272, and a lug (not shown) on one of the conveyor chains actuates the limit switch LS35 as the pallet passes out from the second nailer. The limit switch LS35 energizes the relay CR91 to re-actuate back gauge solenoid SOL-16 and swing the back gauge down into its initial blocking position awaiting the next pallet. The completed pallet proceeds to the inspection station on the inspection conveyor 266 where the second inspector observes the completed pallet for defects.

From the foregoing description it will be seen that the pallet assembling system of the present invention provides an efficient means whereby pallets can be readily assembled with but five operating personnel (including two inspectors) and two conventional nailing machines. The system can be operated at production rates of up to eight pallets per minute.

Although the best mode contemplated for carrying out the present invention has been herein shown and described, it will be apparent that modification and variation may be made without departing from what is regarded to be the subject matter of the invention.

I claim:

1. A pallet assembling system for assembling a pallet comprised of a plurality of deck boards placed crosswise to and on both sides of a plurality of spaced parallel stringers, said system comprising a first nailing machine, means for simultaneously feeding one set of deck boards to said first nailing machine, means for individually and sequentially feeding said stringers to said first nailing machine and for aligning said stringers within said first nailing machine in a position underlying said one set of deck boards for receipt of fasteners from said nailing machine, means for indexing said one set of deck boards after the delivery of each successive stringer to the nailing machine and the nailing of said deck boards to said stringer, a turnover device positioned downstream from said first nailing machine for reversing the orientation of the half-formed pallet after the first set of deck boards have been nailed by rotating it through 180° to place the unnailed side of the pallet face up, a second nailing machine, means for feeding said turned pallet to said second nailing machine, means for feeding a second set of deck boards to said second nailing machine in a position overlying said turned pallet, and diverting means located between said first nailing machine and said pallet feeding means of the second nailing machine for providing an offset in the path of the pallet through the system so that the deck boards for the second nailing machine can be directly loaded into said pallet feeding means at the upstream end thereof by being moved in a direction parallel to their longitudinal axes.

2. A pallet assembling system according to claim 1 including a stop bar for engaging the leading edges of said one set of advancing deck boards for insuring the alignment of the deck boards with the underlying stringer prior to nailing, and means responsive to the completion of said nailing of the first stringer to said deck boards for moving said stop bar to a position out of the path of the pallet prior to continued downstream movement of said one set of deck boards.

3. A pallet assembling system according to claim 1 wherein said means for feeding said one set of deck boards includes a magazine for carrying spaced stacks of said deck boards and further includes means for stripping the lowermost layer of deck boards in said stacks and for feeding said layer of deck boards to said first nailing machine.

4. A pallet assembling system according to claim 3 wherein said stringer feeding means comprises conveying means for moving a plurality of aligned stringers to said first nailing machine, means for controlling the movement of said conveying means, and means for successively engaging the furthest downstream stringer on said conveying means and for moving such stringer into nailing position in said first nailing machine prior to the movement of the next successive stringer into contact with said one set of deck boards.

5. A pallet assembling system according to claim 4 wherein said stringer feeding means further includes a magazine for carrying aligned stacks of said stringers and means for stripping the lowermost layer of stringers from said stacks and for feeding said layer of stringers to said conveying means for moving said stringers to said first nailing machine.

6. A pallet assembling system according to claim 5 wherein said stringer stripping means feeds said layer of stringers in a direction transverse to the direction of movement of said stringer conveying means and said deck board stripping means.

7. A pallet assembling system for assembling a pallet comprised of a plurality of deck boards placed crosswise to and on both sides of a plurality of spaced parallel stringers, said system comprising a first nailing machine, means for feeding one set of deck boards to said first nailing machine, means for individually and sequentially engaging said stringers, means connected to said engaging means for individually moving said stringers to an aligned position with said one set of deck boards in said first nailing machine, means for indexing said one set of deck boards after the delivery of each stringer to the nailing machine and the nailing of said deck boards to said stringer, means positioned downstream from said first nailing machine for rotating the half-formed pallet of said one set of deck boards and said stringers to place the unnailed side of the pallet face up, a second nailing machine, means for feeding said turned pallet to said second nailing machine, means for feeding a second set of deck boards in unison to said second nailing machine in a position overlying said rotated pallet, and diverting means located between said first nailing machine and said pallet feeding means of the second nailing machine for providing an offset in the path of the pallet through the system so that the deck boards for the second nailing machine can be directly loaded into said pallet feeding means at the upstream end thereof by being moved in a direction parallel to their longitudinal axes.

8. A pallet assembling system for assembling a pallet comprised of a plurality of deck boards placed crosswise to and on both sides of a plurality of spaced parallel stringers, said system comprising a first nailing machine, means for feeding one set of deck boards to said first nailing machine, an arm adapted to successively rotate each stringer in an arcuate path to its nailing position beneath said one set of deck boards, means for indexing said one set of deck boards after the delivery of each stringer to the nailing machine and the nailing of said deck boards to said stringer, a turnover device positioned downstream from said first nailing machine for reversing the orientation of the half-formed pallet after the first set of deck boards have been nailed by rotating it through 180° to place the unnailed side of the pallet face up, a second nailing machine, means for feeding said turned pallet to said second nailing machine, means for feeding a second set of deck boards to said second nailing machine in a position overlying said turned pallet, and diverting means located between said first nailing machine and said pallet feeding means of the second nailing machine for providing an offset in the path of the pallet through the system so that the deck boards for the second nailing machine can be directly loaded into said pallet feeding means at the upstream end thereof by being moved in a direction parallel to their longitudinal axes.

9. A pallet assembling system for assembling a pallet comprised of a plurality of deck boards placed crosswise to and on both sides of a plurality of spaced parallel stringers, said system comprising a first nailing machine, means for feeding one set of deck boards to said first nailing machine, an arm adapted to successively rotate each stringer in an arcuate path to its nailing position beneath said one set of deck boards, a pocket assembly at said arm's free end for holding a stringer, said pocket assembly including a spring-loaded member capable of pivoting outwardly to release said stringer when the arm is moved downwardly, means for indexing said one set of deck boards after the delivery of each stringer to the nailing machine and the nailing of said deck boards to said stringer, a turnover device positioned downstream from said first nailing machine for reversing the orientation of the half-formed pallet after the first set of deck boards have been nailed by rotating it through 180° to place the unnailed side of the pallet face up, a second nailing machine, means for feeding said turned pallet to said second nailing machine, means for feeding a second set of deck boards to said second nailing machine in a position overlying said turned pallet, and diverting means located between said first nailing machine and said pallet feeding means of the second nailing machine for providing an offset in the path of the pallet through the system so that the deck boards for the second nailing machine can be directly loaded into said pallet feeding means at the upstream end thereof by being moved in a direction parallel to their longitudinal axes.

10. In a pallet assembling system for assembling a pallet comprised of a plurality of deck boards placed crosswise to a plurality of spaced parallel stringers, the combination comprising a nailing machine, means for feeding an aligned set of deck boards to said nailing machine, means for feeding an aligned row of stringers to said nailing machine in a path generally parallel to and below that of said deck board feeding means, means for individually and sequentially moving the endmost stringer on said stringer feeding means to a nailing position in said nailing machine beneath said set of deck boards and for aligning said stringer at said nailing position with said deck boards, and means for indexing said deck boards forwardly after each stringer is nailed thereto.

11. In a pallet assembling system as set forth in claim 10, a stop bar for engaging the leading edges of said set of advancing deck boards for insuring the alignment of the deck boards with the underlying stringer prior to nailing, and means responsive to the completion of said nailing of the first stringer to said deck boards for moving said stop bar to a position out of the path of the pallet prior to continued downstream movement of said one set of deck boards.

12. A pallet assembling system as set forth in claim 10 wherein said means for feeding said set of deck boards includes a magazine for carrying spaced stacks of said deck boards and further includes means for stripping the lowermost layer of deck boards in said stacks and for feeding said layer of deck boards in a straight line path to said nailing machine.

13. In a pallet assembling system as set forth in claim 12 and further including a magazine for carrying aligned stacks of said stringers, and means for stripping the lowermost layer of stringers from said stacks of stringers and for conveying said layer of stringers to said stringer feeding means.

14. In a pallet assembling system as set forth in claim 13 wherein said stringer stripping means is arranged to convey said layer of stringers in a direction transverse to the direction of movement of said stringer feeding means.

15. In a pallet assembling system for assembling a pallet comprised of a plurality of deck boards placed crosswise to a plurality of spaced parallel stringers, the combination comprising a nailing machine, means for feeding an aligned set of deck boards to said nailing machine, means for feeding an aligned row of stringers to said nailing machine in a path generally parallel to that of said deck board feeding means, an arm adapted to rotate each stringer in an arcuate path from a horizontal to a vertical position and to successively move the endmost stringer on said stringer feeding means to a nailing position in said nailing machine beneath said set of deck boards, and means for indexing said deck boards forwardly after each stringer is nailed thereto.

16. In a pallet assembling system for assembling a pallet comprised of a plurality of deck boards placed crosswise to a plurality of spaced parallel stringers, the combination comprising a nailing machine, means for feeding an aligned set of deck boards to said nailing machine, means for feeding an aligned row of stringers to said nailing machine in a path generally parallel to that of said deck board feeding means, an arm adapted to rotate each stringer in an arcuate path from a horizontal to a vertical position and to successively move the endmost stringer on said stringer feeding means to a nailing position in said nailing machine beneath said set of deck boards, a pocket assembly at said arm's free end for holding a stringer, said pocket assembly including a spring-loaded member capable of pivoting outwardly to release said stringer when the arm is rotated downwardly, and means for indexing said deck boards forwardly after each stringer is nailed thereto.

17. A method of assembling a pallet comprised of a plurality of deck boards placed crosswise to a plurality of spaced parallel stringers, said method including the steps of placing a plurality of deck boards in spaced parallel stacks, stripping the lowermost layer of deck boards in said stacks and moving said layer into position to be nailed by a nailing machine, moving a continuous row of stringers along a path parallel to the path of said deck boards, removing individually and successively the end stringer off of said row of stringers, and moving said end stringer to said nailing machine in an aligned nailing position directly below said deck boards.

18. A method of assembling a pallet comprised of a plurality of deck boards placed crosswise to and on both sides of a plurality of spaced parallel stringers, said method comprising the steps of automatically feeding one set of deck boards and stringers to a first nailing machine in a straight line path to cause them to be nailed together in said machine with the deck boards being aligned and moved simultaneously in a direction parallel to their longitudinally extending axes, flipping the half-formed pallet over while it continues in said path, shifting the horizontal direction of movement of said turned-over pallet by 90°, shifting the horizontal direction of movement of the pallet again by 90° to move the pallet in a second straight line path parallel to but offset from said first path, feeding a second set of deck boards in a direction parallel to said second path of the pallet and into a second nailing machine with the deck boards being aligned and moved simultaneously in a direction parallel to their longitudinally extending axes, bringing said pallet into said second nailing machine in said second path beneath said second set of deck boards, and completing the nailing of the second set of deck boards to said pallet in said second nailing machine.

* * * * *

UNITED STATES PATENT OFFICE

CERTIFICATE OF CORRECTION

PATENT NO. : 3,968,560

DATED : July 13, 1976

INVENTOR(S) : Garye R. Vial

It is certified that error appears in the above-identified patent and that said Letters Patent are hereby corrected as shown below:

Column 17, line 5, "Cr6" should be --CR6--.

Signed and Sealed this

Seventeenth Day of May 1977

[SEAL]

*Attest:*

RUTH C. MASON
*Attesting Officer*

C. MARSHALL DANN
*Commissioner of Patents and Trademarks*